US008469648B2

(12) United States Patent
Orgeron

(10) Patent No.: US 8,469,648 B2
(45) **Date of Patent: *Jun. 25, 2013**

(54) APPARATUS AND METHOD FOR PRE-LOADING OF A MAIN ROTATING STRUCTURAL MEMBER

(75) Inventor: Keith J. Orgeron, Houston, TX (US)

(73) Assignee: T&T Engineering Services, Tomball, TX (US)

( * ) Notice: Subject to any disclaimer, the term of this patent is extended or adjusted under 35 U.S.C. 154(b) by 229 days.

This patent is subject to a terminal disclaimer.

(21) Appl. No.: 12/259,252

(22) Filed: Oct. 27, 2008

(65) Prior Publication Data

US 2010/0032213 A1 Feb. 11, 2010

(51) Int. Cl.
*E21B 19/00* (2006.01)
*H01L 21/68* (2006.01)

(52) U.S. Cl.
USPC ..... 414/22.55; 414/783; 414/742; 901/48

(58) Field of Classification Search
USPC ..... 166/77.52–77.53; 175/85; 212/231; 414/22.54, 22.55, 22.56, 22.57, 22.58, 22.59, 414/22.62, 23, 546, 680, 729, 738, 740, 742, 414/746.8, 783; 52/115, 116, 119, 120; 74/103, 74/110; 901/15, 21–22
See application file for complete search history.

(56) References Cited

U.S. PATENT DOCUMENTS

| | | | |
|---|---|---|---|
| 62,404 | A | 2/1867 | Gile et al. |
| 184,168 | A | 11/1876 | Nickle |
| 364,077 | A | 5/1887 | Addis |
| 514,715 | A | 2/1894 | Jenkins |
| 1,175,792 | A | 3/1916 | Mickelsen |
| 1,264,867 | A | 4/1918 | Schuh |
| 1,312,009 | A | 8/1919 | Thrift |
| 1,318,789 | A | 10/1919 | Moschel |

(Continued)

FOREIGN PATENT DOCUMENTS

| | | | |
|---|---|---|---|
| EP | 0 024 433 | A1 | 3/1981 |
| GB | 727780 | A | 4/1955 |

(Continued)

OTHER PUBLICATIONS

U.S. Appl. No. 12/013,979, filed Jan. 14, 2008, Orgeron, Keith J.

(Continued)

*Primary Examiner* — Gregory Adams
(74) *Attorney, Agent, or Firm* — John F. Fischer, Esq.; Paul D. Lein, Esq.; Scheef & Stone, L.L.P.

(57) ABSTRACT

An apparatus for a pipe handling apparatus has a main rotating structural member rotating about a pivot axis relative to a skid and moving from a first position to a second position. A tensioning mechanism is affixed to the main rotating structural member. The tensioning mechanism applies a tension to the main rotating structural member when the main rotating structural member is in the second position. The tensioning mechanism has a first cable having an end attached adjacent a top of the main rotating structural member, and a second cable having an end attached adjacent the top of the main rotating structural member. The first and second cables have opposite ends attached to a fixed surface. The first and second cables extend angularly outwardly from a front of the main rotating structural member. The first and second cables extend angularly outwardly from the sides of the main rotating structural member.

22 Claims, 12 Drawing Sheets

U.S. PATENT DOCUMENTS

| | | | | | |
|---|---|---|---|---|---|
| 1,369,165 | A | | 2/1921 | Cochran et al. | |
| 1,396,317 | A | | 11/1921 | Boyter | |
| 1,417,490 | A | | 5/1922 | Brandon | |
| 1,483,037 | A | | 2/1924 | Zallinger | |
| 1,768,861 | A | | 7/1930 | Richards | |
| 1,972,635 | A | | 9/1934 | Whinnen | |
| 1,981,304 | A | | 11/1934 | Brandt | |
| 2,124,154 | A | | 7/1937 | Sovincz | |
| 2,147,002 | A | | 2/1939 | Volpin | |
| 2,327,461 | A | * | 8/1943 | Rowe | 254/327 |
| 2,328,197 | A | | 8/1943 | Cowin | |
| 2,369,534 | A | | 2/1945 | Cohen | |
| 2,382,767 | A | | 8/1945 | Zeilman | |
| 2,476,210 | A | | 7/1949 | Moore | |
| 2,497,083 | A | | 2/1950 | Hildebrand | |
| 2,509,853 | A | | 5/1950 | Wilson | |
| 2,535,054 | A | | 12/1950 | Ernst et al. | |
| 2,595,307 | A | | 5/1952 | Selberg | |
| 2,592,168 | A | | 8/1952 | Morris et al. | |
| 2,710,431 | A | | 6/1955 | Griffon | |
| 2,715,014 | A | | 8/1955 | Garnett et al. | |
| 2,770,493 | A | | 11/1956 | Fieber | |
| 2,814,396 | A | | 11/1957 | Neal, Sr. | |
| 2,828,024 | A | | 3/1958 | True | |
| 2,840,244 | A | | 6/1958 | Thomas, Jr. | |
| 2,937,726 | A | * | 5/1960 | Walther et al. | 52/114 |
| 3,016,992 | A | | 1/1962 | Wilson | |
| 3,033,529 | A | | 5/1962 | Pierrat | |
| 3,059,905 | A | | 10/1962 | Tompkins | |
| 3,076,560 | A | | 2/1963 | Bushong et al. | |
| 3,136,394 | A | | 6/1964 | Woolslayer et al. | |
| 3,177,944 | A | | 4/1965 | Knight | |
| 3,180,496 | A | * | 4/1965 | Smith | 212/176 |
| 3,194,313 | A | | 7/1965 | Fanshawe | |
| 3,262,593 | A | | 7/1966 | Hainer | |
| 3,280,920 | A | | 10/1966 | Scott | |
| 3,290,006 | A | | 12/1966 | Dubberke | |
| 3,331,585 | A | | 7/1967 | Dubberke | |
| 3,365,762 | A | | 1/1968 | Spiri | |
| 3,421,269 | A | | 1/1969 | Medow | |
| 3,432,159 | A | | 3/1969 | Rakatansky | |
| 3,464,507 | A | | 9/1969 | Alexander | |
| 3,477,522 | A | * | 11/1969 | Templeton | 173/196 |
| 3,498,375 | A | | 3/1970 | McEwen et al. | |
| 3,559,821 | A | | 2/1971 | James | |
| 3,561,811 | A | | 2/1971 | Turner, Jr. | |
| 3,633,771 | A | | 1/1972 | Woolslayer et al. | |
| 3,675,303 | A | | 7/1972 | McKinnon | |
| 3,682,259 | A | | 8/1972 | Cintract et al. | |
| 3,702,640 | A | | 11/1972 | Cintract et al. | |
| 3,703,968 | A | * | 11/1972 | Uhrich et al. | 414/680 |
| 3,706,347 | A | | 12/1972 | Brown | |
| 3,774,781 | A | | 11/1973 | Merkley | |
| 3,792,783 | A | | 2/1974 | Brown | |
| 3,797,672 | A | * | 3/1974 | Vermette | 52/116 |
| 3,804,264 | A | * | 4/1974 | Hedeen et al. | 212/295 |
| 3,805,463 | A | | 4/1974 | Lang et al. | |
| 3,806,021 | A | | 4/1974 | Moroz et al. | |
| 3,823,916 | A | | 7/1974 | Shaw | |
| 3,848,850 | A | | 11/1974 | Bemis | |
| 3,860,122 | A | | 1/1975 | Cernosek | |
| 3,883,009 | A | | 5/1975 | Swoboda et al. | |
| 3,942,593 | A | | 3/1976 | Reeve, Jr. et al. | |
| 3,963,133 | A | | 6/1976 | Gilli | |
| 3,986,619 | A | | 10/1976 | Woolslayer et al. | |
| 3,991,887 | A | * | 11/1976 | Trout | 414/22.52 |
| 3,995,746 | A | | 12/1976 | Usagida | |
| 4,007,782 | A | | 2/1977 | Nybo et al. | |
| 4,011,694 | A | | 3/1977 | Langford | |
| 4,030,698 | A | | 6/1977 | Hansen | |
| 4,044,952 | A | | 8/1977 | Williams et al. | |
| 4,135,340 | A | | 1/1979 | Cox et al. | |
| 4,142,551 | A | | 3/1979 | Wilms | |
| 4,158,283 | A | | 6/1979 | Nation | |
| 4,172,684 | A | | 10/1979 | Jenkins | |
| 4,201,022 | A | | 5/1980 | Jennings | |
| 4,221,269 | A | | 9/1980 | Hudson | |
| 4,269,554 | A | | 5/1981 | Jackson | |
| 4,276,918 | A | * | 7/1981 | Sigouin | 144/24.13 |
| 4,277,044 | A | | 7/1981 | Hamilton | |
| 4,290,495 | A | | 9/1981 | Elliston | |
| 4,303,270 | A | | 12/1981 | Adair | |
| 4,336,840 | A | | 6/1982 | Bailey | |
| 4,359,089 | A | | 11/1982 | Strate et al. | |
| 4,386,883 | A | | 6/1983 | Hogan et al. | |
| 4,403,666 | A | | 9/1983 | Willis | |
| 4,403,897 | A | | 9/1983 | Willis | |
| 4,403,898 | A | | 9/1983 | Thompson | |
| 4,407,629 | A | | 10/1983 | Willis | |
| 4,420,917 | A | | 12/1983 | Parlanti | |
| 4,426,182 | A | | 1/1984 | Frias et al. | |
| 4,440,536 | A | | 4/1984 | Scaggs | |
| 4,492,501 | A | | 1/1985 | Haney | |
| 4,529,094 | A | | 7/1985 | Wadsworth | |
| 4,547,110 | A | | 10/1985 | Davidson et al. | |
| 4,595,066 | A | | 6/1986 | Nelmark et al. | |
| 4,598,509 | A | * | 7/1986 | Woolslayer et al. | 52/118 |
| 4,604,724 | A | | 8/1986 | Shaginian et al. | |
| 4,605,077 | A | | 8/1986 | Boyadjieff | |
| 4,650,237 | A | | 3/1987 | Lessway | |
| 4,658,970 | A | | 4/1987 | Oliphant | |
| 4,688,983 | A | | 8/1987 | Lindbom | |
| 4,708,581 | A | | 11/1987 | Adair | |
| 4,756,204 | A | | 7/1988 | Wittwer et al. | |
| 4,759,414 | A | * | 7/1988 | Willis | 175/170 |
| 4,765,225 | A | | 8/1988 | Birchard | |
| 4,765,401 | A | | 8/1988 | Boyadjieff | |
| 4,767,100 | A | | 8/1988 | Philpot | |
| 4,822,230 | A | | 4/1989 | Slettedal | |
| 4,834,604 | A | | 5/1989 | Brittain et al. | |
| 4,837,992 | A | | 6/1989 | Hashimoto | |
| 4,869,137 | A | | 9/1989 | Slator | |
| 4,982,853 | A | | 1/1991 | Kishi | |
| 5,060,762 | A | | 10/1991 | White | |
| 5,121,793 | A | | 6/1992 | Busch et al. | |
| 5,135,119 | A | | 8/1992 | Larkin | |
| 5,150,642 | A | | 9/1992 | Moody et al. | |
| 5,186,264 | A | | 2/1993 | du Chaffaut | |
| 5,415,057 | A | | 5/1995 | Nihei et al. | |
| 5,458,454 | A | | 10/1995 | Sorokan | |
| 5,595,248 | A | | 1/1997 | Denny | |
| 5,597,987 | A | | 1/1997 | Gilliland et al. | |
| 5,609,226 | A | | 3/1997 | Penisson | |
| 5,609,260 | A | * | 3/1997 | Liao | 212/279 |
| 5,609,457 | A | | 3/1997 | Burns | |
| 5,649,745 | A | | 7/1997 | Anderson | |
| 5,660,087 | A | | 8/1997 | Rae | |
| 5,671,932 | A | | 9/1997 | Chapman | |
| 5,702,139 | A | | 12/1997 | Buck | |
| 5,806,589 | A | | 9/1998 | Lang | |
| 5,816,565 | A | | 10/1998 | McGuffin | |
| 5,848,647 | A | | 12/1998 | Webre et al. | |
| 5,931,238 | A | | 8/1999 | Gilmore et al. | |
| 5,934,028 | A | | 8/1999 | Taylor | |
| 5,957,431 | A | | 9/1999 | Serda, Jr. | |
| 5,964,550 | A | | 10/1999 | Blandford et al. | |
| 5,988,299 | A | | 11/1999 | Hansen et al. | |
| 5,992,801 | A | | 11/1999 | Torres | |
| 5,993,140 | A | | 11/1999 | Crippa | |
| 6,003,598 | A | | 12/1999 | Andreychuk | |
| 6,047,771 | A | | 4/2000 | Roynestad | |
| 6,053,255 | A | | 4/2000 | Crain | |
| 6,079,490 | A | | 6/2000 | Newman | |
| 6,079,925 | A | | 6/2000 | Morgan et al. | |
| 6,158,516 | A | | 12/2000 | Smith et al. | |
| 6,220,807 | B1 | | 4/2001 | Sorokan | |
| 6,227,587 | B1 | | 5/2001 | Terral | |
| 6,234,253 | B1 | | 5/2001 | Dallas | |
| 6,237,445 | B1 | | 5/2001 | Wesch, Jr. | |
| 6,253,845 | B1 | | 7/2001 | Belik | |
| 6,263,763 | B1 | | 7/2001 | Feigel, Jr. et al. | |
| 6,264,128 | B1 | | 7/2001 | Shampine et al. | |
| 6,264,395 | B1 | | 7/2001 | Allamon et al. | |
| 6,276,450 | B1 | | 8/2001 | Seneviratne | |
| 6,279,662 | B1 | | 8/2001 | Sonnier | |
| 6,298,928 | B1 | | 10/2001 | Penchansky | |
| 6,311,788 | B1 | | 11/2001 | Weixler | |

| | | | | |
|---|---|---|---|---|
| 6,343,892 | B1 | 2/2002 | Kristiansen | |
| 6,398,186 | B1 | 6/2002 | Lemoine | |
| 6,431,286 | B1 | 8/2002 | Andreychuk | |
| 6,471,439 | B2 | 10/2002 | Allamon et al. | |
| 6,502,641 | B1 | 1/2003 | Carriere et al. | |
| 6,524,049 | B1 | 2/2003 | Minnes | |
| 6,533,045 | B1 | 3/2003 | Cooper | |
| 6,543,551 | B1 | 4/2003 | Sparks et al. | |
| 6,543,555 | B2 | 4/2003 | Casagrande | |
| 6,550,128 | B1 | 4/2003 | Lorenz | |
| 6,557,641 | B2 | 5/2003 | Sipos et al. | |
| 6,564,667 | B2 | 5/2003 | Bayer et al. | |
| 6,581,698 | B1 | 6/2003 | Dirks | |
| 6,609,573 | B1 | 8/2003 | Day | |
| 6,705,414 | B2 | 3/2004 | Simpson et al. | |
| 6,745,646 | B1 | 6/2004 | Pietras et al. | |
| 6,748,823 | B2 | 6/2004 | Pietras | |
| 6,763,898 | B1 | 7/2004 | Roodenburg et al. | |
| 6,779,614 | B2 | 8/2004 | Oser | |
| 6,814,149 | B2 | 11/2004 | Liess et al. | |
| 6,845,814 | B2 | 1/2005 | Mason et al. | |
| 6,854,520 | B1 | 2/2005 | Robichaux | |
| 6,969,223 | B2 | 11/2005 | Tolmon et al. | |
| 7,017,450 | B2 | 3/2006 | Bangert | |
| 7,021,880 | B2 | 4/2006 | Morelli et al. | |
| 7,028,440 | B2 | 4/2006 | Brisson | |
| 7,028,585 | B2 | 4/2006 | Pietras et al. | |
| 7,036,202 | B2 | 5/2006 | Lorenz | |
| 7,040,411 | B2 | 5/2006 | Kainer et al. | |
| 7,044,315 | B2 * | 5/2006 | Willim | 212/299 |
| 7,055,594 | B1 | 6/2006 | Springett et al. | |
| 7,077,209 | B2 | 7/2006 | McCulloch et al. | |
| 7,090,035 | B2 | 8/2006 | Lesko | |
| 7,090,254 | B1 | 8/2006 | Pietras et al. | |
| 7,117,938 | B2 | 10/2006 | Hamilton et al. | |
| 7,121,166 | B2 | 10/2006 | Drzewiecki | |
| 7,172,038 | B2 | 2/2007 | Terry et al. | |
| 7,249,639 | B2 | 7/2007 | Belik | |
| 7,289,871 | B2 | 10/2007 | Williams | |
| 7,296,623 | B2 | 11/2007 | Koithan et al. | |
| 7,398,833 | B2 | 7/2008 | Ramey et al. | |
| 7,438,127 | B2 | 10/2008 | Lesko | |
| 7,503,394 | B2 | 3/2009 | Bouligny | |
| 7,726,929 | B1 * | 6/2010 | Orgeron | 414/22.55 |
| 7,918,636 | B1 | 4/2011 | Orgeron | |
| 7,946,795 | B2 | 5/2011 | Orgeron | |
| 7,980,802 | B2 | 7/2011 | Orgeron | |
| 8,011,426 | B1 | 9/2011 | Orgeron | |
| 8,128,332 | B2 | 3/2012 | Orgeron | |
| 8,172,497 | B2 | 5/2012 | Orgeron et al. | |
| 8,192,128 | B2 | 6/2012 | Orgeron | |
| 8,192,129 | B1 | 6/2012 | Orgeron | |
| 8,235,104 | B1 | 8/2012 | Sigmar et al. | |
| 2002/0070187 | A1 * | 6/2002 | Willim | 212/299 |
| 2002/0079105 | A1 | 6/2002 | Bergeron | |
| 2003/0170095 | A1 | 9/2003 | Slettedal | |
| 2003/0221871 | A1 | 12/2003 | Hamilton et al. | |
| 2004/0040926 | A1 * | 3/2004 | Irsch et al. | 212/347 |
| 2005/0269133 | A1 | 12/2005 | Little | |
| 2006/0016775 | A1 * | 1/2006 | Willim | 212/347 |
| 2006/0027793 | A1 | 2/2006 | Kysely | |
| 2006/0045654 | A1 | 3/2006 | Guidroz | |
| 2006/0151215 | A1 | 7/2006 | Skogerbo | |
| 2006/0278400 | A1 | 12/2006 | Bouligny | |
| 2007/0074460 | A1 | 4/2007 | Belik | |
| 2008/0023432 | A1 | 1/2008 | Paschke | |
| 2008/0078965 | A1 | 4/2008 | Lane et al. | |
| 2008/0174131 | A1 | 7/2008 | Bouligny et al. | |
| 2008/0202812 | A1 | 8/2008 | Childers et al. | |
| 2008/0253866 | A1 * | 10/2008 | Lops et al. | 414/22.55 |
| 2009/0071720 | A1 | 3/2009 | Cowan | |
| 2010/0032213 | A1 * | 2/2010 | Orgeron | 175/85 |
| 2010/0187740 | A1 | 7/2010 | Orgeron | |
| 2010/0230166 | A1 | 9/2010 | Sigmar et al. | |
| 2010/0296899 | A1 * | 11/2010 | Orgeron | 414/22.55 |
| 2011/0030942 | A1 | 2/2011 | Orgeron | |
| 2011/0200412 | A1 | 8/2011 | Orgeron | |
| 2012/0118639 | A1 | 5/2012 | Gerber | |
| 2012/0167485 | A1 | 7/2012 | Trevithick et al. | |
| 2012/0170998 | A1 | 7/2012 | Orgeron | |

FOREIGN PATENT DOCUMENTS

| | | | |
|---|---|---|---|
| GB | 2264736 | A | 9/1993 |
| JP | 05-044385 | A | 2/1993 |
| JP | 2001-287127 | A | 10/2001 |
| WO | 93/15303 | A1 | 8/1993 |
| WO | 02/57593 | A1 | 7/2002 |
| WO | WO 2006038790 | A1 * | 4/2006 |

OTHER PUBLICATIONS

Chronis, Nicholas P.; Mechanisms & Mechanical Devices Sourcebook, 1991, Ch. 10, pp. 399-414, ISBN 0-07-010918-4, McGraw-Hill, Inc.

U.S. Appl. No. 12/111,907, filed Apr. 29, 2008; non-published; titled "Pipe Gripping Apparatus" and having a common inventor with the present patent application; now abandoned.

U.S. Appl. No. 12/371,590, filed Feb. 14, 2009; non-published; titled "Tubular Gripping Apparatus With Locking Mechanism" and having a common inventor with the present application.

U.S. Appl. No. 12/371,593, filed Feb. 14, 2009; non-published; titled "Pipe Handling Apparatus With Stab Frame Stiffening" and having a common inventor with the present patent application.

U.S. Appl. No. 12/632,261, filed Dec. 7, 2009; non-published; titled "Stabbing Apparatus and Method" and having a common inventor with the present application.

U.S. Appl. No. 12/633,891, filed Dec. 9, 2009; non-published; titled "Stabbing Apparatus for Centering Tubulars and Casings for Connection at a Wellhead" and having a common inventor with the present application.

U.S. Appl. No. 13/114,842, filed May 24, 2011; non-published; titled "Telescoping Jack for a Gripper Assembly" and having a common inventor with the present application.

U.S. Appl. No. 13/226,343, filed Sep. 6, 2011; non-published; titled "Method of Gripping a Tubular With a Tubular Gripping Mechanism" and having a common inventor with the present application.

* cited by examiner

APPARATUS AND METHOD FOR PRE-LOADING OF A MAIN ROTATING STRUCTURAL MEMBER

BACKGROUND OF THE INVENTION

1. Field of the Invention

The present invention relates to pipe handling apparatus. More particularly, the present invention relates to pipe handling apparatus that have a main rotating structural member rotating about a pivot axis. More particularly, the present invention relates to controlling undesirable forces that are created while positioning a tubular at a well head. More particularly, the present invention relates to apparatus for tensioning the main rotating structural member of the pipe handling apparatus.

2. Description of Related Art Including Information Disclosed Under 37 CFR 1.97 and 37 CFR 1.98.

Drill rigs have utilized several methods for transferring tubular members from a pipe rack adjacent to the drill floor to a mousehole in the drill floor or the well bore for connection to a previously transferred tubular or tubular string. The term "tubular" as used herein includes all forms of pipe, drill pipe, drill collars, casing, liner, bottom hole assemblies (BHA), and other types of tubulars known in the art.

Conventionally, drill rigs have utilized a combination of the rig cranes and the traveling system for transferring a tubular from the pipe rack to a vertical position above the center of the well. The obvious disadvantage with the prior art systems is that there is a significant manual involvement in attaching the pipe elevators to the tubular and moving the pipe from the drill rack to the rotary table at the well head. This manual transfer operation in the vicinity of workers is potentially dangerous and has caused numerous injuries in drilling operations. Further, the hoisting system may allow the tubular to come into contact with the catwalk or other portions of the rig as the tubular is transferred from the pipe rack to the drill floor. This can damage the tubular and may affect the integrity of the connections between successive tubulars in the well.

One method of transferring pipe from the rack to the well platform comprises tying one end of a line on the rig around a selected pipe on the pipe rack. The pipe is thereafter lifted up onto the platform and the lower end thereof is placed into the mousehole. The mousehole is simply an upright, elongate cylindrical container adjacent to the rotary table which supports the pipe temporarily. When it is necessary to add the pipe to the drill string, slips are secured about the drill string on the rotary table thereby supporting the same in the well bore. The pipe is disconnected from the traveling equipment, and the elevators, or the kelly, are connected to the pipe in the mousehole. Next, the traveling block is raised by positioning the pipe over the drill string. Tongs are used to secure the pipe to the upper end of the drill string. The drill pipe elevators suspend the drill pipe from a collar, which is formed around one end of the pipe and does not clamp the pipe, thereby permitting rotational pipe movement in order to threadably engage the same to the drill string.

A prior art technique for moving joints of casing from racks adjacent to the drilling rig comprises tying a line from the rig onto one end of a selected casing joint on the rack. The line is raised by lifting the casing joint up a ramp leading to the rig platform. As the rope lifts the casing from the rack, the lower end of the casing swings across the platform in a dangerous manner. The danger increases when a floating system is used in connection with drilling. Because the rope is tied around the casing at one end thereof, the casing does not hang vertically, but rather tilts somewhat. A man working on a platform elevated above the rig floor must hold the top of the casing and straighten it out while the casing is threaded into the casing string which is suspended in the well bore by slips positioned on the rotary table.

It is desirable to be able to grip casing or pipe positioned on a rack adjacent a drilling well, move the same into vertical orientation over the well bore, and thereafter lower the same onto the string suspended in the well bore.

In the past, various devices have been created which mechanically move a pipe from a horizontal orientation to a vertical orientation such that the vertically oriented pipe can be installed into the well bore. Typically, these devices have utilized several interconnected arms that are associated with a main rotating structural member. In order to move the pipe, a succession of individual movements of the levers, arms, and other components of the main rotating structural member must be performed in a coordinated manner in order to achieve the desired result. Typically, a wide variety of hydraulic actuators are connected to each of the components so as to carry out the prescribed movement. A complex control mechanism is connected to each of these actuators so as to achieve the desired movement. Advanced programming is required of the controller in order to properly coordinate the movements in order to achieve this desired result.

Unfortunately, with such systems, the hydraulic actuators, along with other components, can become worn with time. Furthermore, the hydraulic integrity of each of the actuators can become compromised over time. As such, small variations in each of the actuators can occur. These variations, as they occur, can make the complex mechanism rather inaccurate. The failure of one hydraulic component can exacerbate the problems associated with the alignment of the pipe in a vertical orientation. Adjustments of the programming are often necessary so to as to continue to achieve the desired results. Fundamentally, the more hydraulic actuators that are incorporated into such a system, the more likely it is to have errors, inaccuracies, and deviations in the desired delivery profile of the tubular. Typically, very experienced and knowledgeable operators are required so as to carry out this pipe movement operation. This adds significantly to the cost associated with pipe delivery.

In the past, pipe handling apparatus have not been used for the installation of casing. The problem associated with casing is that the threads of the casing are formed on an inner wall and on an outer wall at the ends of each of the casing sections. Whenever these threads are formed, the relatively thin wall thickness of the casing is further minimized. Additionally, great precision is required so as to properly thread the threads of one casing section within the threads of an adjacent casing section. The amount of accuracy required for the delivery of the casing by a pipe handling apparatus, in the past, has not been sufficient so as to achieve the desired degree of accuracy for the installation of the casing sections in their threaded connection. The improper installation of one casing section upon another casing section can potentially damage the threads associated with such casing sections. Additionally, in the past, the pipe handling apparatus could potentially damage the thin-walled casing sections during the delivery. As such, a need has developed to adapt a pipe handling apparatus so as to achieve the desired amount of accuracy for the installation of casing sections.

To address these problems and needs, U.S. application Ser. No. 11/923,451, filed on Oct. 24, 2007, by the present inventor discloses a pipe handling apparatus that has a boom pivotally movable between a first position and a second position, a riser assembly pivotally connected to the boom, an arm pivotally connected at one end to the first portion of the riser assembly and extending outwardly therefrom, a gripper affixed to an opposite end of the arm suitable for gripping a diameter of the pipe, a link pivotally connected to the riser assembly and pivotable so as to move relative to the movement of the boom between the first and second positions, and a brace having one end pivotally connected to the boom and an opposite end pivotally connected to the arm between the ends of the arm. The riser assembly has a first portion extending outwardly at an obtuse angle with respect to the second portion.

The pipe handling apparatus delivers a pipe to a well head in the second position. Pipes can be of extraordinary lengths and weights. Once the pipe is connected to other pipe in the well head, the grippers of the pipe handling apparatus release the pipe. A problem associated with the pipe handling apparatus is that once the grippers release the pipe at the well head, the apparatus springs upwardly and away from the well head. This is due to the release of the massive weight of the pipe. This springback causes unnecessary stresses on the pipe handling apparatus and can cause structural damage to the apparatus, such as cracking and bending. Upon the release of the pipe, the grippers and the arm of the pipe handling apparatus can have a springback of up to ten inches. This creates large spikes in the stresses on the boom of the pipe handling apparatus. In addition to creating unnecessary stresses on the boom, the springback can cause the pipe to be deflected at the well head. Moreover, the accuracy of the pipe handling apparatus decreases when this springback occurs. Thus, there is a need to avoid the springback and minimize the deflection of the apparatus that is caused by the release of the pipe at the well head. These problems also occur when casing is delivered to the well head by the pipe handling apparatus.

In the past, various patents and patent applications relate to apparatus and methods for stiffening a pipe handling apparatus. For example, U.S. patent application Ser. No. 12/013,979, filed on Jan. 14, 2008, by the present applicant, discloses a pre-loading system for a pipe handling apparatus in which a boom is pivotally mounted at one end to a skid and in which an arm is interconnected to an opposite end of the boom. The pre-loading system has a tensioning system with one end affixed to the arm and an opposite end fixedly mounted so as to apply tension to the arm when the arm has a load applied to an end of the arm opposite the boom. The tensioning system includes a first cable assembly having one end interconnected to the arm and an opposite end fixedly mounted, and a second cable assembly interconnected to the arm and having an opposite end fixedly mounted. The first and second cable assemblies extend from opposite sides of the arm.

U.S. Pat. No. 3,177,944, issued on Apr. 13, 1965, to R. N. Knights, describes a racking mechanism for earth boring equipment that provides for horizontal storage of pipe lengths on one side of and clear of the derrick. This is achieved by means of a transport arm which is pivoted toward the base of the derrick for swing movement in a vertical plane. The outer end of the arm works between a substantially vertical position in which it can accept a pipe length from, or deliver a pipe length to, a station in the derrick, and a substantially horizontal portion in which the arm can deliver a pipe length to, or accept a pipe length from, a station associated with storage means on one side of the derrick.

U.S. Pat. No. 3,464,507, issued on Sep. 2, 1969, to E. L. Alexander et al., teaches a portable rotary pipe handling system. This system includes a mast pivotally mounted and movable between a reclining transport position to a desired position at the site drilling operations which may be at any angle up to vertical. The mast has guides for a traveling mechanism that includes a block movable up and down the mast through operation of cables reeved from the traveling block over crown block pulleys into a drawwork. A power drill drive is carried by the traveling block. An elevator for drill pipe is carried by an arm swingably mounted relative to the power unit. Power tongs, slips, and slip bushings are supported adjacent the lower end of the mast and adapted to have a drill pipe extend therethrough from a drive bushing connected to a power drive whereby the drill pipe is extended in the direction of the hole to be drilled.

U.S. Pat. No. 3,633,771, issued on Jan. 11, 1972, to Woolslayer et al., discloses an apparatus for moving drill pipe into and out of an oil well derrick. A stand of pipe is gripped by a strongback which is pivotally mounted to one end of a boom. The boom swings the strongback over the rotary table thereby vertically aligning the pipe stand with the drill string. When both adding pipe to and removing pipe from the drill string, all vertical movement of the pipe is accomplished by the elevator suspended from the traveling block.

U.S. Pat. No. 3,860,122, issued on Jan. 14, 1975, to L. C. Cemosek, describes an apparatus for transferring a tubular member, such as a pipe, from a storage area to an oil well drilling platform. The positioning apparatus includes a pipe positioner mounted on a platform for moving the pipe to a release position whereby the pipe can be released to be lowered to a submerged position. A load means is operably attached or associated with the platform and positioning means in order to move the pipe in a stored position to a transfer position in which the pipe is transferred to the positioner. The positioner includes a tower having a pipe track pivotally mounted thereon with pipe clamp assemblies which are adapted to receive a pipe length. The pipe track is pivotally movable by a hydraulic power mechanism or gear mechanism between a transfer position in which pipe is moved into the clamp assemblies and the release position in which the pipe is released for movement to a submerged position.

U.S. Pat. No. 3,986,619, issued on Oct. 19, 1976, to Woolslayer et al., shows a pipe handling apparatus for an oil well drilling derrick. In this apparatus, the inner end of the boom is pivotally supported on a horizontal axis in front of a well. A clamping means is pivotally connected to the outer end of the boom on an axis parallel to the horizontal axis at one end. The clamping means allows the free end of the drill pipe to swing across the boom as the outer end of the boom is raised or lowered. A line is connected at one end with the traveling block that raises and lowers the elevators and at the other end to the boom so as to pass around sheaves.

U.S. Pat. No. 4,172,684, issued on Oct. 30, 1979, to C. Jenkins, shows a floor-level pipe handling apparatus which is mounted on the floor of an oil well derrick. The apparatus includes a support that is rockable on an axis perpendicular to the centerline of a well being drilled. One end of an arm is pivotally mounted on the support on an axis transverse to the centerline of the well. The opposite end of the arm carries a pair of shoes having laterally opening pipe-receiving seats facing away from the arm. The free end of the arm can be swung toward and away from the well centerline and the arm support can be rocked to swing the arm laterally.

U.S. Pat. No. 4,403,666, issued on Sep. 13, 1983, to C. A. Willis, shows self-centering tongs and a transfer arm for a drilling apparatus. The clamps of the transfer arm are resiliently mounted to the transfer arm so as to provide limited axial movement of the clamps and thereby of a clamped down hole tubular. A pair of automatic, self-centering, hydraulic tongs are provided for making up and breaking out threaded connections of tubulars.

U.S. Pat. No. 4,407,629, issued on Oct. 4, 1983, to C. A. Willis, teaches a lifting apparatus for downhole tubulars. This lifting apparatus includes two rotatably mounted clamps which are rotatable between a side loading-position so as to facilitate the loading and unloading in the horizontal position, and a central position, in which a clamped tubular is aligned with the drilling axis when the boom is in the vertical position. An automatic hydraulic sequencing circuit is provided to automatically rotate the clamps into the side-loading position whenever the boom is pivoted with a down-hole tubular positioned in the clamp. In this position, the clamped tubular is aligned with a safety plate mounted on the boom to prevent a clamped tubular from slipping from the clamps.

U.S. Pat. No. 4,492,501, issued on Jan. 8, 1985, to K. M. Haney, provides a platform positioning system for a drilling operation which includes a support structure and a transfer arm pivotally connected to the support structure to rotate about a first axis. This platform positioning system includes a platform which is pivotally connected to the support structure to rotate about a second axis, and rod which is mounted between the transfer arm and the platform. The position of the arm and platform axes and the length of the rod are selected such that the transfer arm automatically and progressively raises the platform to the raised position by means of the rod as the transfer arm moves to the raised position. The transfer arm automatically and progressively lowers the platform to the lowered position by means of the rod as the transfer arm moves to the lowered position.

U.S. Pat. No. 4,595,066, issued on Jun. 17, 1986, to Nelmark et al., provides an apparatus for handling drill pipes and used in association with blast holes. This system allows a drill pipe to be more easily connected and disconnected to a drill string in a hole being drilled at an angle. A receptacle is formed at the lower end of the carrier that has hydraulically-operated doors secured by a hydraulically-operated lock. A gate near the upper end is pneumatically operated in response to the hydraulic operation of the receptacle lock.

U.S. Pat. No. 4,822,230, issued on Apr. 18, 1989, to P. Slettedal, teaches a pipe handling apparatus which is adapted for automated drilling operations. Drill pipes are manipulated between substantially horizontal and vertical positions. The apparatus is used with a top mounted drilling device which is rotatable about a substantially horizontal axis. The apparatus utilizes a strongback provided with clamps to hold and manipulate pipes. The strongback is rotatably connected to the same axis as the drilling device. The strongback moves up or down with the drilling device. A brace unit is attached to the strongback to be rotatable about a second axis.

U.S. Pat. No. 4,834,604, issued on May 30, 1989, to Brittain et al., provides a pipe moving apparatus and method for moving casing or pipe from a horizontal position adjacent a well to a vertical position over the well bore. The machine includes a boom movable between a lowered position and a raised position by a hydraulic ram. A strongback grips the pipe and holds the same until the pipe is vertically positioned. Thereafter, a hydraulic ram on the strongback is actuated thereby lowering the pipe or casing onto the string suspended in the well bore and the additional pipe or casing joint is threaded thereto.

U.S. Pat. No. 4,708,581 issued on Nov. 24, 1987, H. L. Adair, provides a method for positioning a transfer arm for the movement of drill pipe. A drilling mast and a transfer arm are mounted at a first axis adjacent the mast to move between a lowered position near ground level and an upper position aligned with the mast. A reaction point anchor is fixed with respect to the drilling mast and spaced from the first axis. A fixed length link is pivotably mounted to the transfer arm at a second axis, spaced from the first axis, and a first single stage cylinder is pivotably mounted at one end to the distal end of the link and at the other end to the transfer arm. A second single stage hydraulic cylinder is pivotably mounted at one end to the distal end of the link and at the other end to the reaction point.

U.S. Pat. No. 4,759,414, issued on Jul. 26, 1988, to C. A. Willis, provides a drilling machine which includes a drilling superstructure skid which defines two spaced-apart parallel skid runners and a platform. The platform supports a drawworks mounted on a drawworks skid and a pipe boom is mounted on a pipe boom skid sized to fit between the skid runners of the drilling substructure skid. The drilling substructure skid supports four legs which, in turn, support a drilling platform on which is mounted a lower mast section. The pipe boom skid mounts a pipe boom as well as a boom linkage, a motor, and a hydraulic pump adapted to power the pipe boom linkage. Mechanical position locks hold the upper skid in relative position over the lower skid.

U.S. Pat. No. 5,458,454, issued on Oct. 17, 1995, to R. S. Sorokan, describes a pipe handling method which is used to move tubulars used from a horizontal position on a pipe rack adjacent the well bore to a vertical position over the wall center. This method utilizes bicep and forearm assemblies and a gripper head for attachment to the tubular. The path of the tubular being moved is close to the conventional path of the tubular utilizing known cable transfer techniques so as to allow access to the drill floor through the V-door of the drill rig. U.S. Pat. No. 6,220,807 describes apparatus for carrying out the method of U.S. Pat. No. 5,458,454.

U.S. Pat. No. 6,609,573, issued on Aug. 26, 2003, to H. W. F. Day, teaches a pipe handling system for an offshore structure. The pipe handling system transfers the pipes from a horizontal pipe rack adjacent to the drill floor to a vertical orientation in a set-back area of the drill floor where the drill string is made up for lowering downhole. The cantilevered drill floor is utilized with the pipe handling system so as to save platform space.

U.S. Pat. No. 6,705,414, issued on Mar. 16, 2004, to Simpson et al., describes a tubular transfer system for moving pipe between a substantial horizontal position on the catwalk and a substantially vertical position at the rig floor entry. Bundles of individual tubulars are moved to a process area where a stand make-up/break-out machine makes up the tubular stands. The bucking machine aligns and stabs the connections and makes up the connection to the correct torque. The tubular stand is then transferred from the machine to a stand storage area. A trolley is moved into position over the pick-up area to retrieve the stands. The stands are clamped to the trolley and the trolley is moved from a substantially horizontal position to a substantially vertical position at the rig floor entry. A vertical pipe-racking machine transfers the stands to the traveling equipment. The traveling equipment makes up the stand connection and the stand is run into the hole.

U.S. Pat. No. 6,779,614, issued on Aug. 24, 2004, to M. S. Oser, shows another system and method for transferring pipe. A pipe shuttle is used for moving a pipe joint into a first position and then lifting upwardly toward an upper second position.

It is an object of the present invention to provide an apparatus and method for enhancing the structural integrity of a main rotating structural member of a pipe handling apparatus when delivering a pipe to a well head.

It is another object of the present invention to provide an apparatus and method for stiffening a main rotating structural member of a pipe handling apparatus that minimizes the amount of calibration required in order to move the pipe from a horizontal orientation to a vertical orientation.

It is another object of the present invention to provide an apparatus and method for stiffening a main rotating structural member of a pipe handling apparatus that operates within a single degree of freedom so as to move the pipe without adjustments between the components.

It is still another object of the present invention to provide an apparatus and method for stiffening the main rotating structural member of a pipe handling apparatus that minimizes the number of components added to the apparatus so as to accomplish such stiffening.

It is another object of the present invention to provide an apparatus and method for stiffening a pipe handling apparatus that prevents damage of the components of the pipe handling apparatus.

It is another object of the present invention to provide an apparatus and method for stiffening a pipe handling apparatus that prevents sideways or transverse motions of the pipe handling apparatus.

It is another object of the present invention to provide an apparatus and method for stiffening that achieves greater precision in the delivery and insulation of pipe and/or casing.

It is another object of the present invention to provide an apparatus and method for stiffening a pipe handling apparatus that increases the structural stiffness of the apparatus.

It is another object of the present invention to provide an apparatus and method for stiffening pipe that serves to minimize the weight and size of the components of the main rotating structural member of a pipe handling apparatus.

These and other objects and advantages of the present invention will become apparent from a reading of the attached specification and appended claims.

BRIEF SUMMARY OF THE INVENTION

The present invention is a pipe handling apparatus that has a skid, and a main rotating structural member rotating about a pivot axis relative to a skid. The main rotating structural member moves between a first position and a second position. A tensioning apparatus is affixed adjacent to an upper end of the main rotating structural member. The tensioning apparatus applies a tension to the main rotating structural member when the main rotating structural member is in the second position.

In the preferred embodiment, the tensioning apparatus comprises a first cable having an end adjacent to a top of the main rotating structural member, and a second cable having an end adjacent to the top of the main rotating structural member. The first and second cables extend angularly outwardly from a front of said main rotating structural member. The first cable has an opposite end attached to a fixed surface. The second cable has an opposite end attached to the fixed surface. The first cable extends angularly outwardly from a side of the main rotating structural member. The second cable extends angularly outwardly from an opposite side of the main rotating structural member. The first and second cables tension the main rotating structural member in the second position. The first and second cables are slack when the main rotating structural member is in the first position.

In a first alternative embodiment, the tensioning apparatus comprises a first cable having an end attached adjacent a top of the main rotating structural member, and a second cable having an end attached adjacent the top of the main rotating structural member. The first cable has an opposite end attached to a fixed surface. The second cable has an opposite end attached to the fixed surface. The first and second cables extend angularly outwardly from a front of the main rotating structural member. The first and second cables are attached to the fixed surface in alignment with the main rotating structural member. The first cable is generally parallel to the side of the main rotating structural member. The second cable is generally parallel to the opposite side of the main rotating structural member.

In a second alternative embodiment, the tensioning apparatus comprises a first cable having an end adjacent a top of the main rotating structural member, and a second cable having an end attached adjacent the top of the main rotating structural member. The first cable has an opposite end attached to a fixed surface. The second cable has an opposite end attached to the fixed surface. The first and second cables are attached to the fixed surface along the pivot axis of the main rotating structural member. The first cable extends angularly outwardly from a side of the main rotating structural member. The second cable extends angularly outwardly from an opposite side of the main rotating structural member. The first and second cables tension the main rotating structural member in the second position. The first and second cables are slack when the main rotating structural member is in the first position.

In a third alternative embodiment, the tensioning apparatus comprises a first cable having an end adjacent a top of the main rotating structural member, and a second cable having an end adjacent the top of the main rotating structural member. The first cable has an opposite end attached in a location near a bottom of the main rotating structural member. The second cable has an opposite end attached in a location near the bottom of the main rotating structural member. The second cable is attached to the side of the main rotating structural member opposite the first cable. The first and second cables tension the main rotating structural member in the second position. The first and second cables are slack when the main rotating structural member is in the first position.

The present invention is a method of tensioning a main rotating structural member of a pipe handling apparatus where the main rotating structural member rotates about a pivot axis from a first position to a second position. The method includes the steps of attaching an end of a first cable adjacent a top of the main rotating structural member, attaching an end of a second cable adjacent the top of the main rotating structural member, and tensioning the main rotating structural member in the second position with the first and second cables.

The preferred method further includes the steps of attaching an opposite end of the first cable to the fixed surface, attaching an opposite end of the second cable to the fixed surface, extending the first cable angularly outwardly from a side of the main rotating structural member, and extending the second cable angularly outwardly from an opposite side of the main rotating structural member.

In a first alternative embodiment, the method further includes the step of attaching an opposite end of the first cable to a fixed surface, attaching an opposite end of the second cable to the fixed surface, and extending the first and second cables in alignment with the main rotating structural member.

In a second alternative embodiment, the method further includes the steps of attaching an opposite end of the first cable to a fixed surface, attaching an opposite end of the second cable to a fixed surface, extending the first cable angularly outwardly from a side of the main rotating structural member, extending the second cable angularly outwardly from an opposite side of the main rotating structural member, and attaching the first and second cables along the pivot axis of the main rotating structural member.

DETAILED DESCRIPTION OF THE INVENTION

Figure 1:
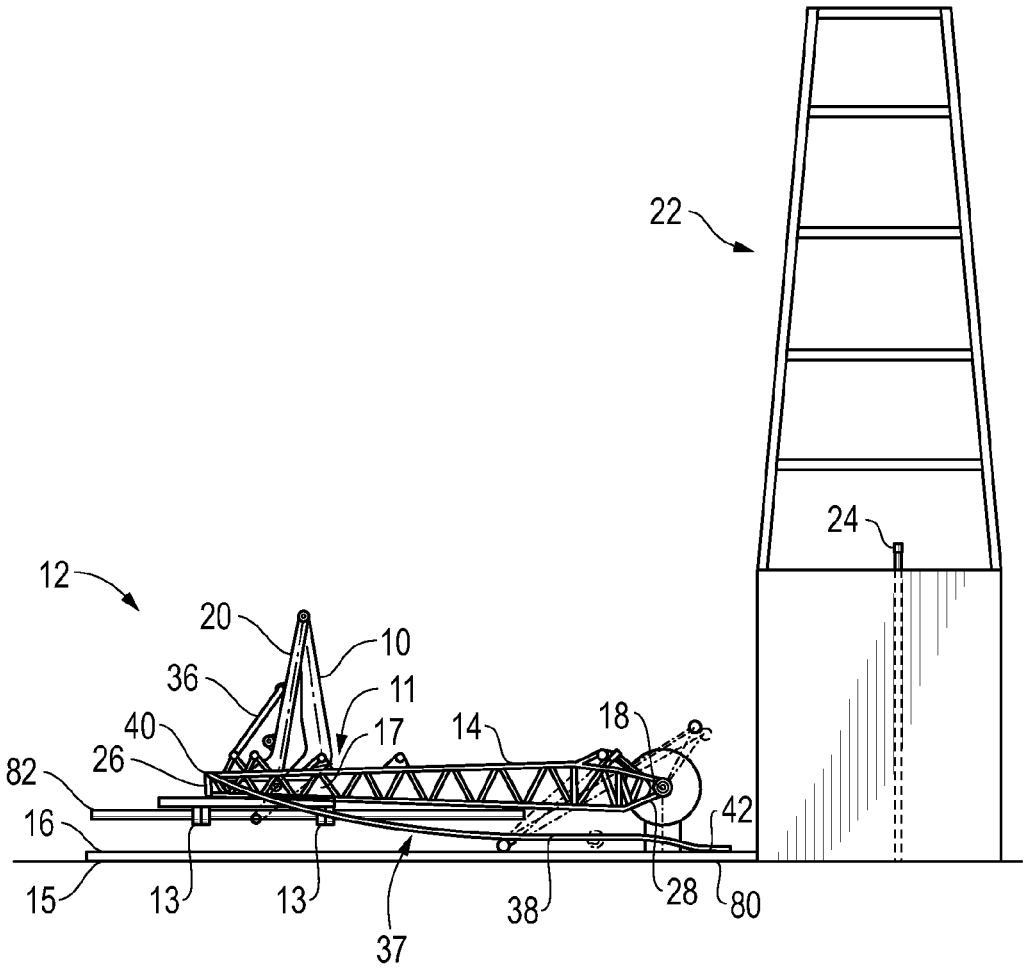
FIG. 1 shows a side elevational view of the preferred embodiment of the apparatus of the present invention, with the pipe handling apparatus in a first position.

Referring to FIG. 1, there is shown a side elevational view of the preferred embodiment of the pipe handling apparatus 12 of the present invention. The pipe handling apparatus 12 is mounted on a skid 16 that is supported upon the bed 15 of a vehicle, such as a truck. The pipe handling apparatus 12 in particular includes a main rotating structural member 14 that is pivotally movable between a first position and a second position. A lever assembly 10 is pivotally connected to the main rotating structural member 14. An arm 20 is pivotally connected to an end of the lever assembly 10 opposite the main rotating structural member 16. A gripping assembly 11 is fixedly connected to an end of the arm 20 opposite the lever assembly 10. The gripping assembly 11 includes a body 17 and grippers 13.

In the present invention, the main rotating structural member 14 is a structural framework of struts, cross members and beams. In particular, in the present invention, the main rotating structural member 14 is configured so as to have an open interior such that the pipe will be able to be lifted in a manner so as to pass through the interior of the main rotating structural member 14. As such, the top 26 of the main rotating structural member 14 should be strongly reinforced so as to provide the necessary structural integrity to the main rotating structural member 14. A lug extends outwardly from one side of the main rotating structural member 14. This lug is suitable for pivotable connection to the lever assembly 10. The main rotating structural member 14 is pivotally connected at the bottom 28 to a location on the skid 16. The pivotable connection at bottom 28 of the main rotating structural member 14 is located in offset relationship and above the pivotable connection of the link with the skid 16. A small frame member extends outwardly from the side of the main rotating structural member 14 opposite the link. This frame assembly has a pivotable connection with the brace. This unique arrangement of the lever assembly 10 facilitates the ability of the present invention to carry out the movement of the pipe 82 between the horizontal orientation and the vertical orientation.

The arm 20 has an end pivotally connected to the lever assembly 10. The opposite end of the arm 20 is connected to the gripping assembly 11. In particular, a pair of pin connections engages a surface of the body 17 of the gripping assembly 11 so as to fixedly position the gripping assembly 11 with respect to the end of the arm 20. The pin connections can be in the nature of bolts, or other fasteners, so as to strongly connect the body 17 of the gripping assembly 11 with the arm 20. The bolts associated with pin connections can be removed such that other gripping assemblies 11 can be affixed to the end of the arm 20. As such, the pipe handling apparatus 12 of the present invention can be adaptable to various sizes of pipe 82 and various heights of drilling rigs 22.

The gripping assembly 11 includes the body 17 with the grippers 13 translatable along the length of the body 17. This vertical translation of the grippers 13 allows the pipe 82 to be properly moved upwardly and downwardly once the vertical orientation of the pipe 82 is achieved. The grippers 13 are in the nature of conventional grippers which can open and close so as to engage the outer diameter of the pipe 82, as desired.

The link 33 is an elongate member that extends from the pivotable connection on the skid 16 to the pivotable connection of the lever assembly 10. The link is non-extensible and extends generally adjacent to the opposite side from the main rotating structural member 14 from that of the arm 20. The link 33 will generally move relative to the movement of the main rotating structural member 14. The brace 36 is pivotally connected to the small framework associated with main rotating structural member 14 and also pivotally connected at a location along the arm 20 between the ends thereof. The brace 36 provides structural support to the arm 20 and also facilitates the desired movement of the arm 20 during the movement of the pipe 82 between the horizontal orientation and the vertical orientation.

Actuators 47, 49 have an end connected to the skid 16 and an opposite end connected to the main rotating structural member 14 in a location above the end. When the actuators 47, 49 are activated, they will pivot the main rotating structural member 14 upwardly from the horizontal orientation ultimately to a position beyond vertical so as to cause the pipe 82 to achieve a vertical orientation. Within the concept of the present invention, a single hydraulic actuator can be utilized instead of the pair of hydraulic actuators.

The drilling rig 22 is illustrated as having drill pipe 24 extending upwardly so as to have an end above the drill floor. When the pipe 82 is in its vertical orientation, the translatable movement of the grippers 13 can be utilized so as to cause the end of the pipe 82 to engage with the box of the drill pipe 24.

In the present invention, the coordinated movement of each of the non-extensible members of the pipe handling apparatus 12 is achieved with proper sizing and angular relationships. In essence, the present invention provides a four-bar link between the various components. As a result, the movement of the drill pipe 82 between a horizontal orientation and a vertical orientation can be achieved purely through the mechanics associated with the various components. Only a single hydraulic actuator may be necessary so as to achieve this desired movement. There does not need to be coordinated movement of hydraulic actuators 47, 49. The hydraulic actuators 47, 49 are only used for the pivoting of the main rotating structural member 14. Because the skid 16 is located on the bed of a vehicle 15, the vehicle 15 can be maneuvered into place so as to properly align with the centerline of the drill pipe 24 of the drilling rig 22. Once the proper alignment is achieved by the vehicle 15, the apparatus 12 can be operated so as to effectively move the drill pipe 82 to its desired position. The gripping assembly 11 of the present invention allows the drill pipe 82 to be moved upwardly and downwardly for the proper stabbing of the drill pipe 24. The present invention is adaptable to various links of pipe 82.

Various types of gripping assemblies 11 can be installed on the end of the arm 20 so as to properly accommodate longer lengths of pipe 82. As such, instead of the complex control mechanisms that are required with prior art systems, the present invention achieves its results by simple maneuvering of the vehicle 15, along with operation of the hydraulic cylinders. All other linkages and movement of the pipe 82 are achieved purely because of the mechanical connections between the various components. As such, the present invention assures a precise, self-centering of the pipe 82 with respect to the desired connecting pipe. This is accomplished with only a single degree of freedom in the pipe handling system.

Referring still to FIG. 1, the pipe handling apparatus 12 is in a first position. The gripper 17 grips a tubular 82 in a horizontal orientation. The tubular 82 can be any tubular structure used in drilling, such as pipe or casing. The tensioning apparatus 37 is attached to the main rotating structural member 14. The tensioning apparatus 37 has a first cable 38. The end 40 of the first cable 38 is attached adjacent a top 26 of the main rotating structural member 14. An opposite end 42 of the first cable 38 is attached to a fixed surface. In FIG. 1, the fixed surface is the skid 16. However, the present invention contemplates that the fixed surface could be the ground 80 or any other structure in a fixed position relative to the main rotating structural member 14. When the pipe handling apparatus 12 is in the first position, the tensioning apparatus 37 is slack. The first cable 38 can be seen as slack in FIG. 1. The pipe handling apparatus 12 is typically placed next to a drilling rig 22. The drilling rig 22 is placed over the drill pipe 24. The pipe handling apparatus 12 is typically located at a height less than the height of the drill pipe 24.

Figure 2:
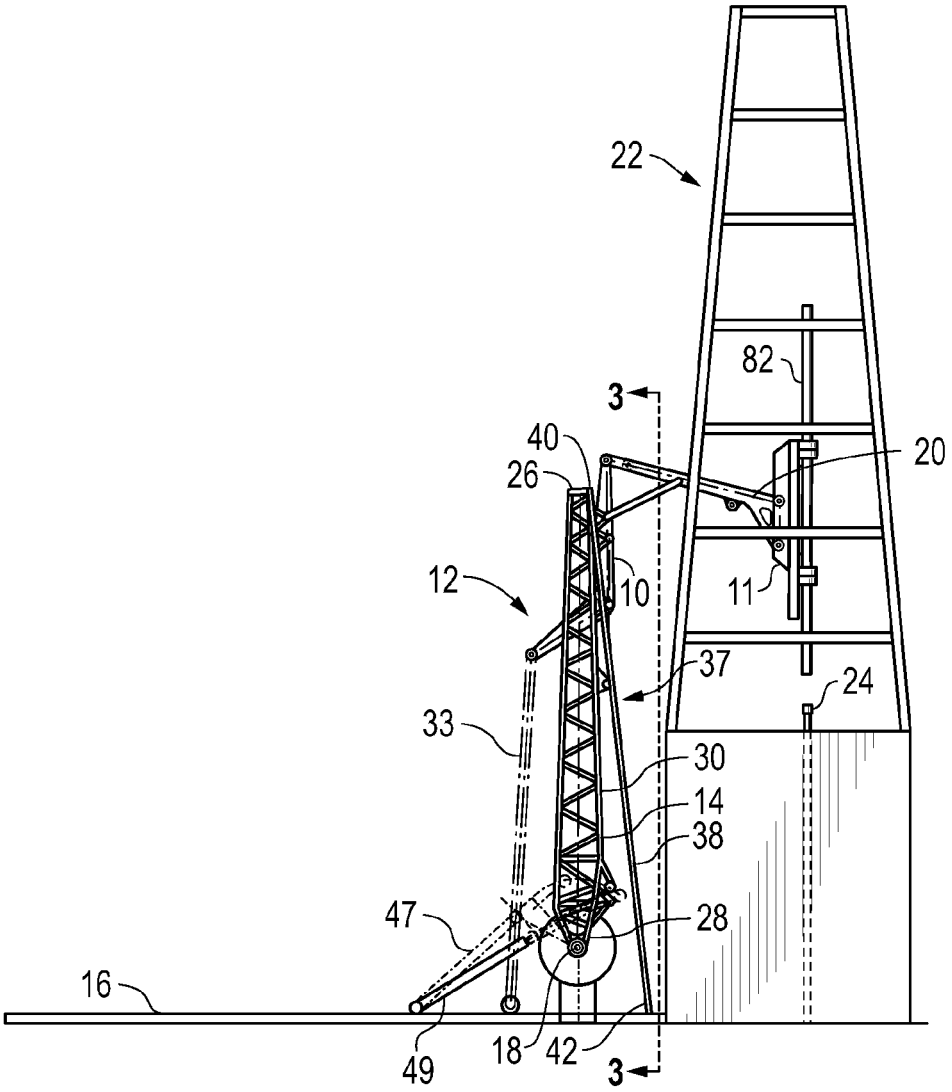
FIG. 2 shows a side elevational view of the preferred embodiment of the apparatus of the present invention, with the pipe handling apparatus in a second position.

Referring to FIG. 2, there is shown a side elevational view of the preferred embodiment of the tensioning apparatus 37, with the pipe handling apparatus 12 in a second position. In the second position, the main rotating structural member 14 of pipe handling apparatus 12 is in an approximately vertical orientation. The arm 20 of the pipe handling apparatus 12 extends outwardly from the lever assembly 10, pivotally attached to the main rotating structural member 14 so that the gripping assembly 11 holds the tubular 82 in a vertical orientation above the drill pipe 24. The first cable 38 can be seen as having end 40 attached adjacent the top 26 of the main rotating structural member 14 and opposite end 42 attached to the fixed surface, the skid 16. The first cable 38 and a second cable (not shown) extend angularly outwardly from a front 30 of the main rotating structural member 14. Having the first cable 38 and second cable (not shown) extending outwardly from the front 30 of the main rotating structural member 14 prevents forward and backward movement of the main rotating structural member 14 while delivering the tubular 82 to the drill pipe 24. It can be seen in FIG. 2 that the first cable 38 and second cable (not shown) tension the main rotating structural member 14 when the main rotating structural member 14 is in the second position. The tension cable 38 gives the main rotating structural member 14 structural rigidity against forward and backward movement. The tension cable 38 provides structural integrity to the main rotating structural member 14 in the second position. This allows the main rotating structural member 14 to be formed of a lighter weight and of smaller and lighter components.

Figure 3:
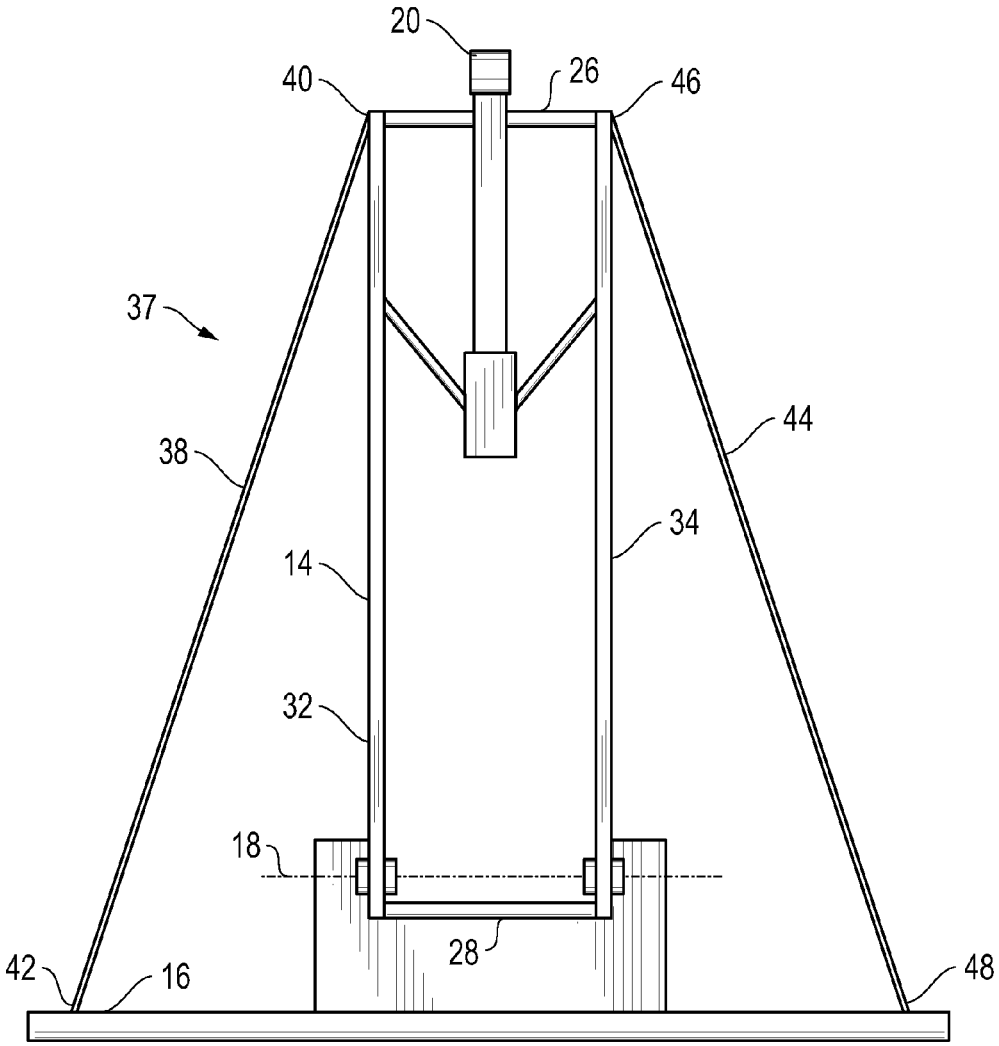
FIG. 3 shows a front elevational view of the preferred embodiment of the apparatus of the present invention.

Referring to FIG. 3, there is shown a front elevational view of the preferred embodiment of the tensioning apparatus 37 of the present invention, taken along sight line 3-3 of FIG. 2. The first cable 38 of the apparatus 12 has end 40 connected to a top 26 of the main rotating structural member 14 and an opposite end 42 attached to the fixed surface of the skid 16. The second cable 44 of the apparatus 12 has an end 46 connected to a top 26 of the main rotating structural member 14 and an opposite end 48 connected to the fixed surface of the skid 16. The main rotating structural member 14 in FIG. 3 is in the second position, which means that the main rotating structural member 14 is in a substantially vertical orientation. The arm 20 of the pipe handling apparatus 12 can be seen as pivotally interconnected to the main rotating structural member 14. The main rotating structural member 14 is pivotally connected to the skid 16 by the pivot axis 18. The first cable 38 extends angularly outwardly from a side 32 of the main rotating structural member 14. The second cable 44 extends angularly outwardly from an opposite side 34 of the main rotating structural member 14. The first and second cables 38 and 44 tension the main rotating structural member 14 when the main rotating structural member 14 is in the vertical orientation of the second position. The first and second cables 38 and 44 prevent sideways or transverse motion of the main rotating structural member 14 due to wind gusts and other sideways forces imparted upon the main rotating structural member 14. Because the first and second cables 38 and 44 angle outwardly from the main rotating structural member 14, they prevent such sideways motion of the main rotating structural member 14.

Another advantage of having the first and second cables 38 and 44 angle outwardly from the front 30 of the main rotating structural member 14 is the cables 38 and 44 tension the main rotating structural member 14 and help prevent springback of the main rotating structural member 14 that can occur when the grippers 13 of the pipe handling apparatus 12 release the tubular 82 at the drill pipe 24.

Figure 4:
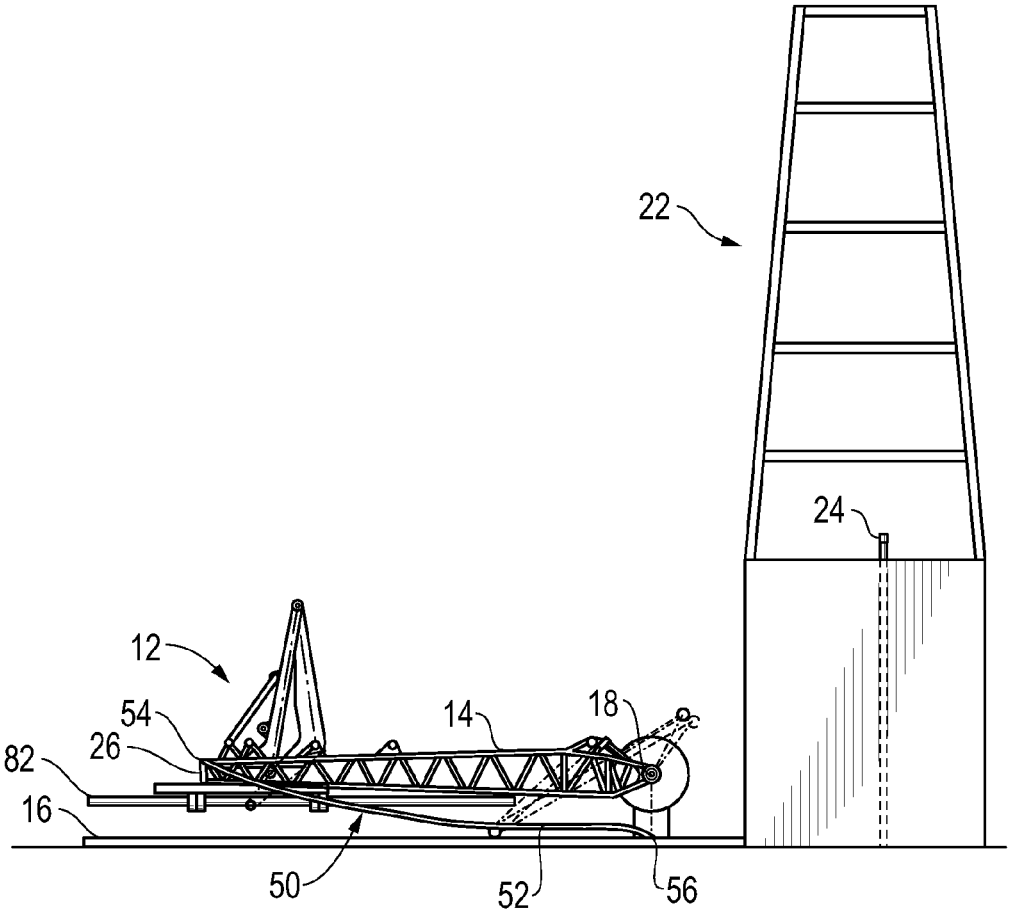
FIG. 4 shows a side elevational view of the first alternative embodiment of the apparatus of the present invention, with the pipe handling apparatus in a first position.

Referring to FIG. 4, there is shown a side elevational view of the first alternative embodiment of the tensioning apparatus 50 of the present invention, with the pipe handling apparatus 12 in a first position. The first cable 52 of the tensioning apparatus 50 can be seen as slack when the pipe handling apparatus 12 is in the first position. The end 54 of the first cable 52 is attached to the top 26 of the main rotating structural member 14. The opposite end 56 of the first cable 52 is attached to a fixed surface, such as the skid 16, in alignment with the pivot axis 18 of the main rotating structural member 14.

Figure 5:
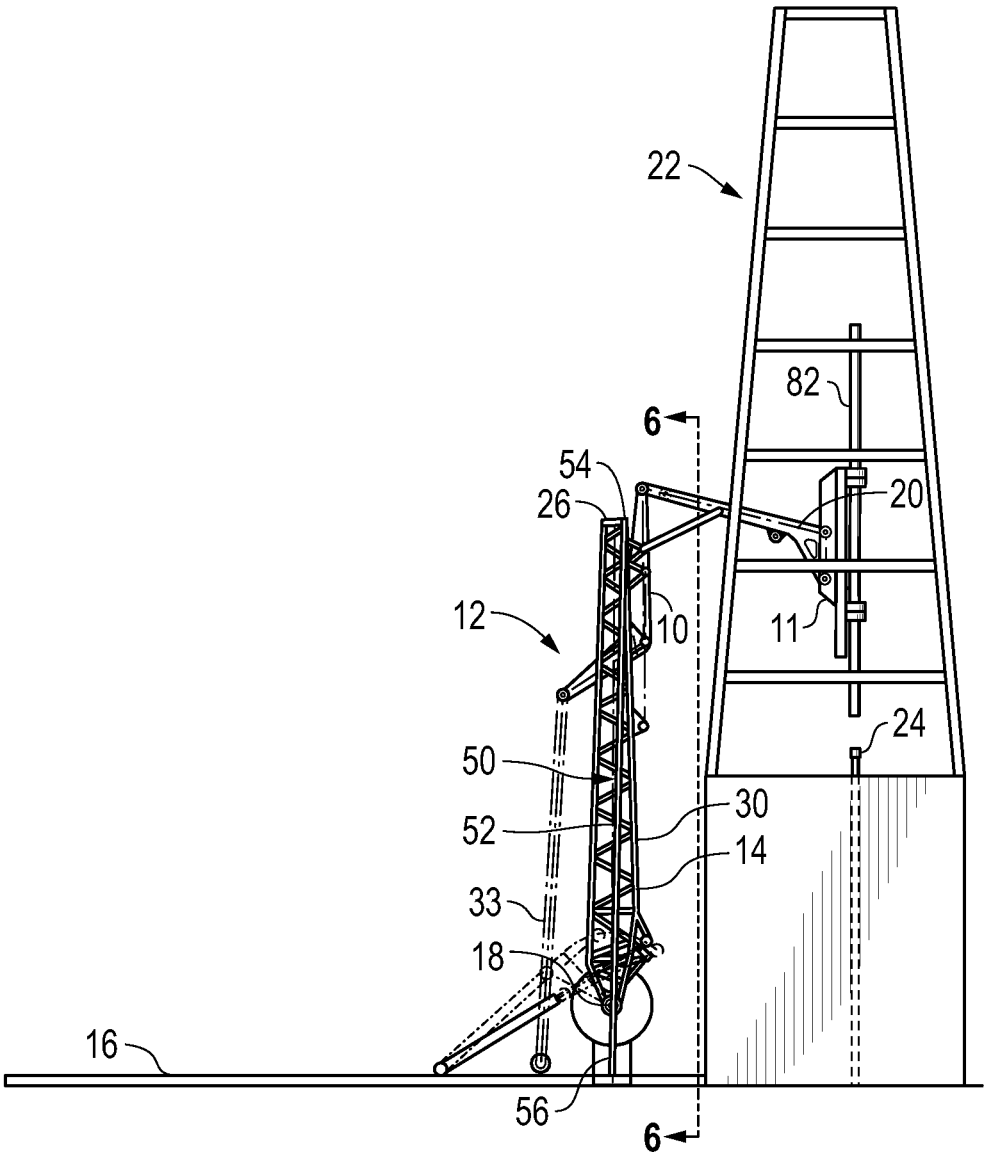
FIG. 5 shows a side elevational view of the first alternative embodiment of the apparatus of the present invention, with the pipe handling apparatus in the second position.

Referring to FIG. 5, there is shown a side elevational view of the first alternative embodiment of the apparatus 50 of the present invention, with the pipe handling apparatus 12 in the second position. In the second position, the main rotating structural member 14 of the pipe handling apparatus 12 is in a vertical orientation. The arm 20 of the pipe handling apparatus 12 extends outwardly from the main rotating structural member 14 so that the gripping assembly 11 holds the tubular 82 in a vertical orientation above the drill pipe 24. When the pipe handling apparatus 12 is in the second position, the first cable 52 tensions the main rotating structural member 14. Because the cable 52 is aligned with the pivot axis 18 of the main rotating structural member 14, the cable 52 helps prevent forward and backward movement of the main rotating structural member 14. The tensioned cable 52 adds rigidity to the main rotating structural member 14 so as to help prevent sideways or transverse movement of the main rotating structural member 14 while delivering the tubular 82 to the drill pipe 24.

Figure 6:
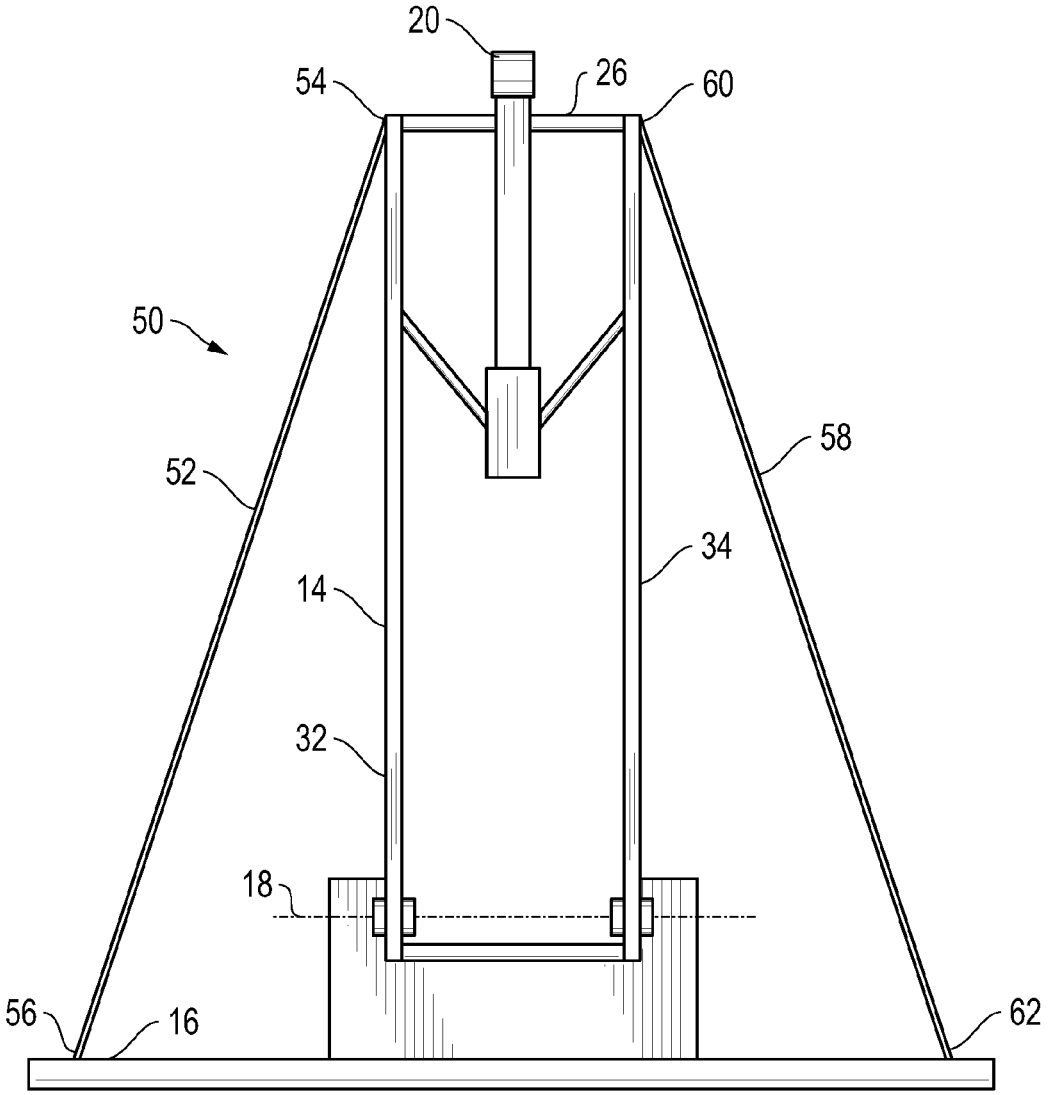
FIG. 6 shows a front elevational view of the first alternative embodiment of the present invention.

Referring to FIG. 6, there is shown a front elevational view of the first alternative embodiment of the apparatus 50 of the present invention, taken along line 6-6 of FIG. 5. The first cable 52 of the apparatus 50 has an end 54 attached to a top 26 of the main rotating structural member 14 and an opposite end 56 attached to the skid 16, which is a fixed surface. The second cable 58 of the apparatus 50 has an end 60 attached to the top 26 of the main rotating structural member 14 and an opposite end 62 attached to the skid 16. End 54 of the first cable 52 is attached to the side 32 of the main rotating structural member 14. End 60 of the second cable 58 is attached to an opposite side 34 of the main rotating structural member 14. The first cable 52 extends angularly outwardly from the side 32 of the main rotating structural member 14. The second cable 58 extends angularly outwardly from the opposite side 34 of the main rotating structural member 14. The first and second cables 52 and 58 are shown in FIG. 6 as tensioning the main rotating structural member 14. The outwardly-angled nature of the first and second cables 52 and 58 tensions the main rotating structural member 14 so as to prevent sideways movement of the main rotating structural member 14 due to wind gusts and other sideways forces imparted upon the main rotating structural member 14. Opposite ends 56 and 62 of the first and second cables 52 and 58, respectively, are located at a distance from the sides 32 and 34 of the main rotating structural member 14 further than the distance of the ends 54 and 60 of the cables 52 and 58, respectively. The location of the ends 56 and 62 of the first and second cables 52 and 58, respectively, along the pivot axis 18 of the main rotating structural member 14 helps prevent springback of the main rotating structural member 14 when the pipe handling apparatus 12 releases the tubular 82 at the drill pipe 24.

Figure 7:
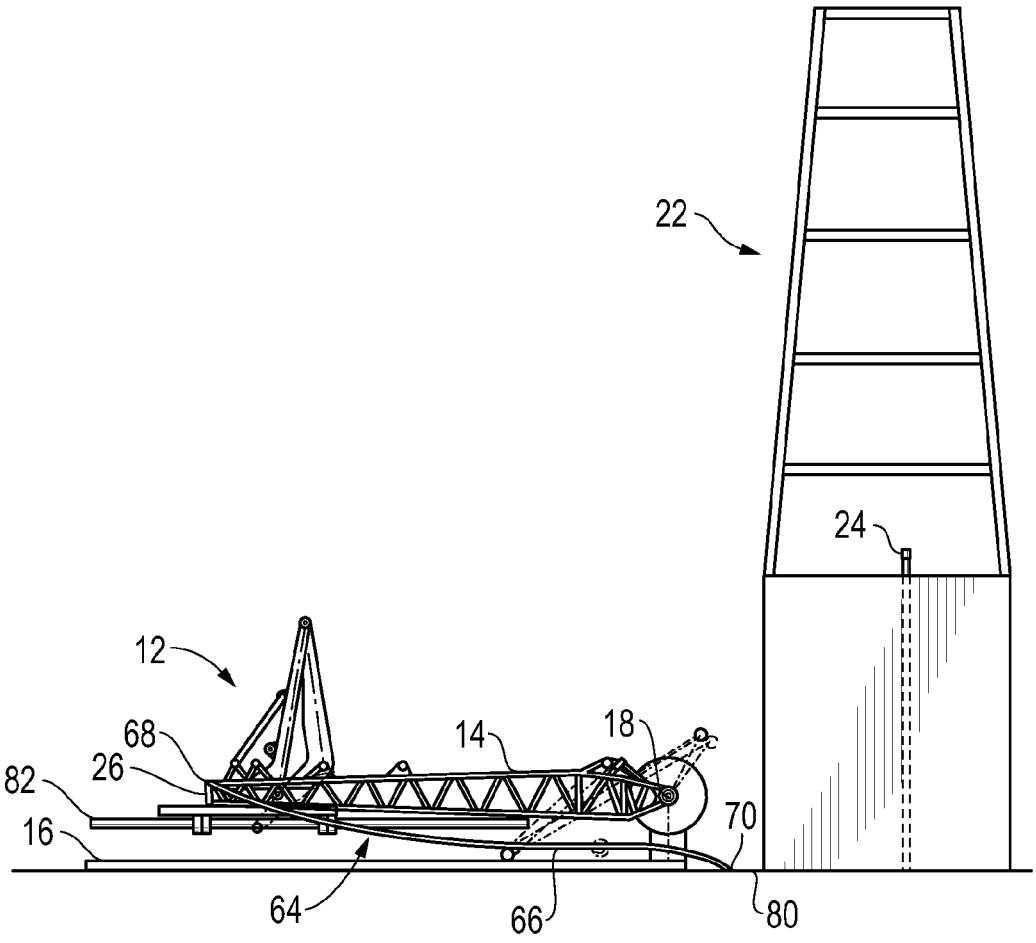
FIG. 7 shows a side perspective view of a second alternative embodiment of the apparatus of the present invention, with the pipe handling apparatus in the first position.

Referring to FIG. 7, there is shown a side elevational view of a second alternative embodiment of the tensioning apparatus 64 of the present invention. The pipe handling apparatus 12 is shown in the first position. The first cable 66 of the tensioning apparatus 64 is shown as slack when the pipe handling apparatus 12 is in the first position. The end 68 of the first cable 66 is attached to the top 26 of the main rotating structural member 14. The opposite end 70 of the first cable 66 is attached to a fixed surface. The fixed surface in FIG. 7 is the ground 80. The fixed surface can also be any other surface that is stationary, such as the skid 16. It is important that the first cable 66 of the tensioning apparatus 64 is slack when the pipe handling apparatus 12 is in the first position so that the pipe handling apparatus 12 can easily move from a first position to a second position. End 70 of the first cable 66 is connected to the ground 80 in front of the pivot axis 18 of the main rotating structural member 14.

Figure 8:
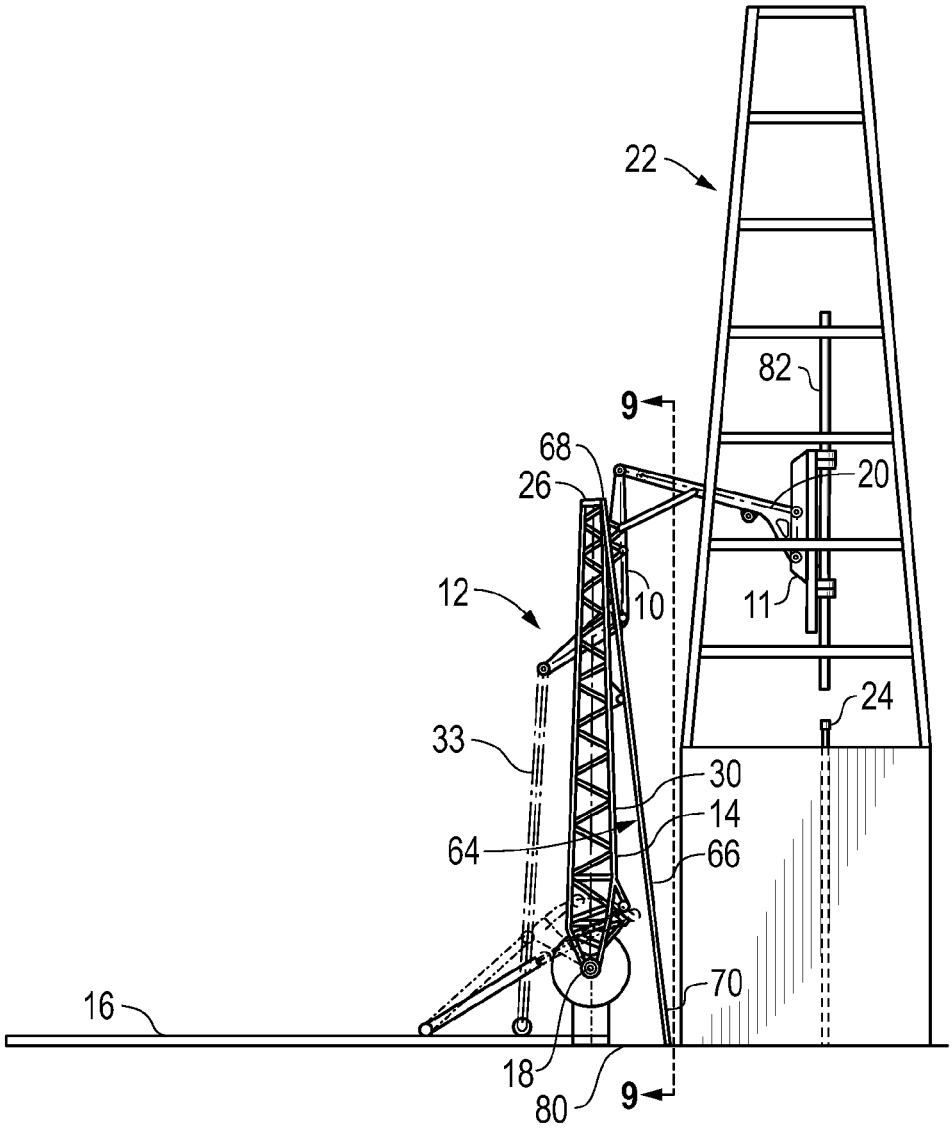
FIG. 8 shows a side elevational view of the second alternative embodiment of the present invention, with the pipe handling apparatus in the second position.

Referring to FIG. 8, there is shown a side elevational view of the second alternative embodiment of the tensioning apparatus 64 of the present invention, with the pipe handling apparatus 12 in the second position. In the second position, the main rotating structural member 14 of the pipe handling apparatus 12 is in a substantially vertical orientation. The arm 20 of the pipe handling apparatus 12 extends angularly outwardly from the main rotating structural member 14 so that the gripping assembly 11 holds the tubular 82 in a vertical orientation over the drill pipe 24. The first cable 66 of the tensioning apparatus 64 can be seen as angularly outwardly from the front 30 of the main rotating structural member 14. Because the first cable 66 angles outwardly, the first cable 66 adds structural rigidity to the main rotating structural member 14 so as to prevent backward and forward movement of the main rotating structural member 14 when delivering the tubular 82 to the drill pipe 24. Moreover, the first cable 66 helps prevent springback of the main rotating structural member 14 which sometimes occurs when the gripping assembly 11 of the pipe handling apparatus 12 releases the tubular 82 at the drill pipe 24.

Figure 9:
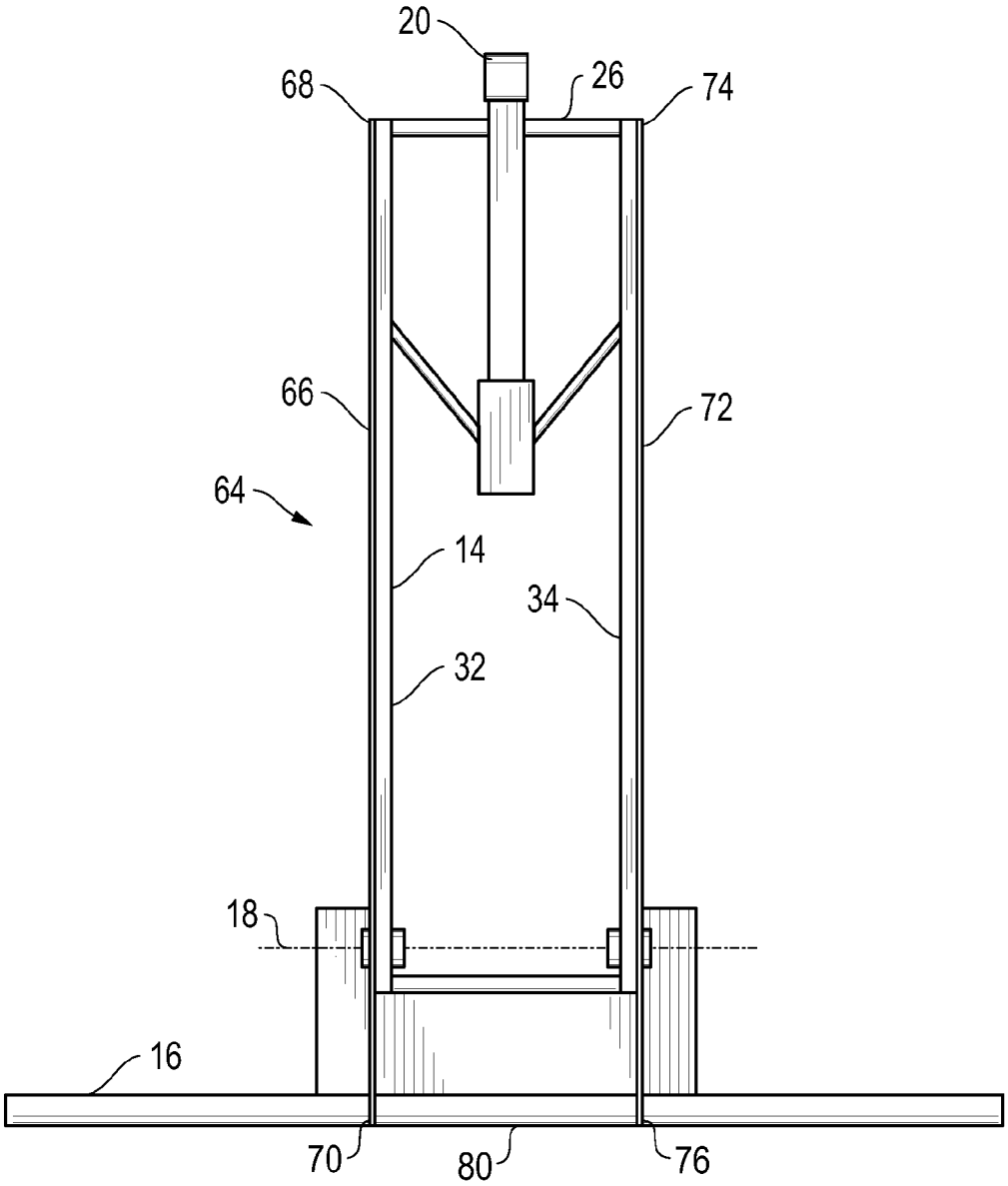
FIG. 9 shows a front elevational view of the second alternative embodiment of the present invention.

Referring to FIG. 9, there is shown a front elevational view of the second alternative embodiment of the apparatus 12 of the present invention, taken along line 9-9 of FIG. 8. The first cable 66 of the tensioning apparatus 64 has an end 68 attached to the top 26 of main rotating structural member 14 and an opposite end 70 attached to the ground 80 in front of the main rotating structural member 14 of the pipe handling apparatus 12. The second cable 72 of the tensioning apparatus 64 has an end 74 attached to the top 26 of the main rotating structural member 14 and an opposite end 76 attached to the ground 80 in front of the skid 16 and the main rotating structural member 14 of the pipe handling apparatus 12. The first and second cables 66 and 72 of the second alternative embodiment of the tensioning apparatus 64 do not angle outwardly from the main rotating structural member 14. Instead, the first cable 66 is parallel to the side 32 of the main rotating structural member 14. The second cable 72 is parallel to the opposite side 34 of the main rotating structural member 14. Extending the first and second cables 66 and 72 parallel to the sides 32 and 34 of the main rotating structural member 14, respectively, adds rigidity to the main rotating structural member 14 so as to help prevent sideways motion of the main rotating structural member 14 due to wind gusts and other transverse forces.

Figure 10:
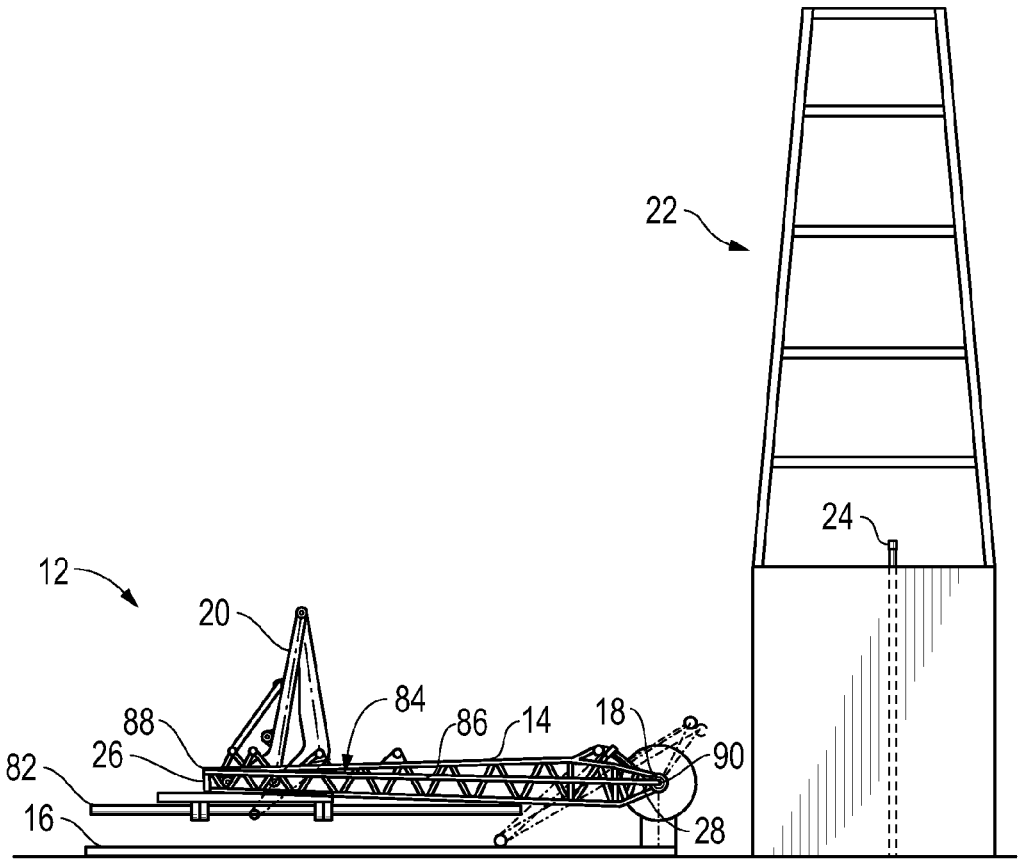
FIG. 10 shows a side elevational view of a third alternative embodiment of the present invention, with the pipe handling apparatus in the first position.

Referring to FIG. 10, there is shown a side elevational view of a third alternative embodiment of the apparatus 84, with the pipe handling apparatus 12 in the first position. In the third alternative embodiment, the first cable 86 of the tensioning apparatus 84 has an end 88 attached to the top 26 of the main rotating structural member 14 and an opposite end 90 attached to a bottom 28 of the main rotating structural member 14. Thus, both ends 88 and 90 of the cable 86 are attached to the main rotating structural member 14. That is, neither end 88 or 90 is attached to a fixed surface. Because neither end 88 or 90 is attached a fixed surface, the cable 86 is tensioned when the main rotating structural member 14 is in the first position. The tension of the first cable 86 adds rigidity to the main rotating structural member 14 when in the first position.

Figure 11:
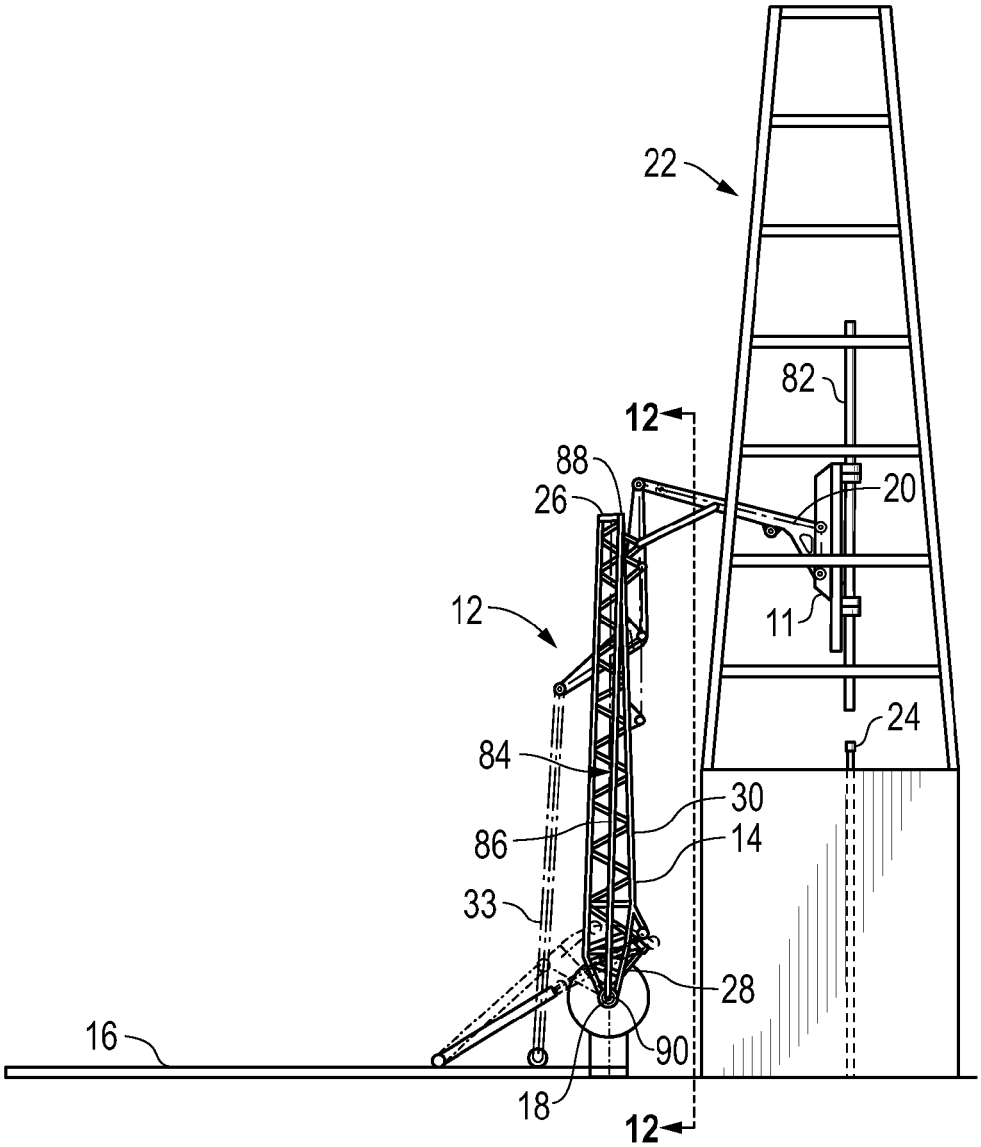
FIG. 11 shows a side elevational view of the third alternative embodiment of the present invention, with the pipe handling apparatus in the second position.

Referring to FIG. 11, there is shown a side elevational view of the third alternative embodiment of the tensioning apparatus 84, with the pipe handling apparatus 12 in the second position. In the second position, the main rotating structural member 14 of the pipe handling apparatus 12 is in a vertical orientation. The arm 20 extends outwardly from the main rotating structural member 14 so that the gripping assembly 11 of the pipe handling apparatus 12 holds tubular 82 in a vertical orientation above the drill pipe 24 of the drilling rig 22. The first cable 86 is tensioned when the pipe handling apparatus 12 is in the second position. Thus, the first cable 86 tensions the main rotating structural member 14 continuously as the main rotating structural member moves between the first position and the second position.

Figure 12:
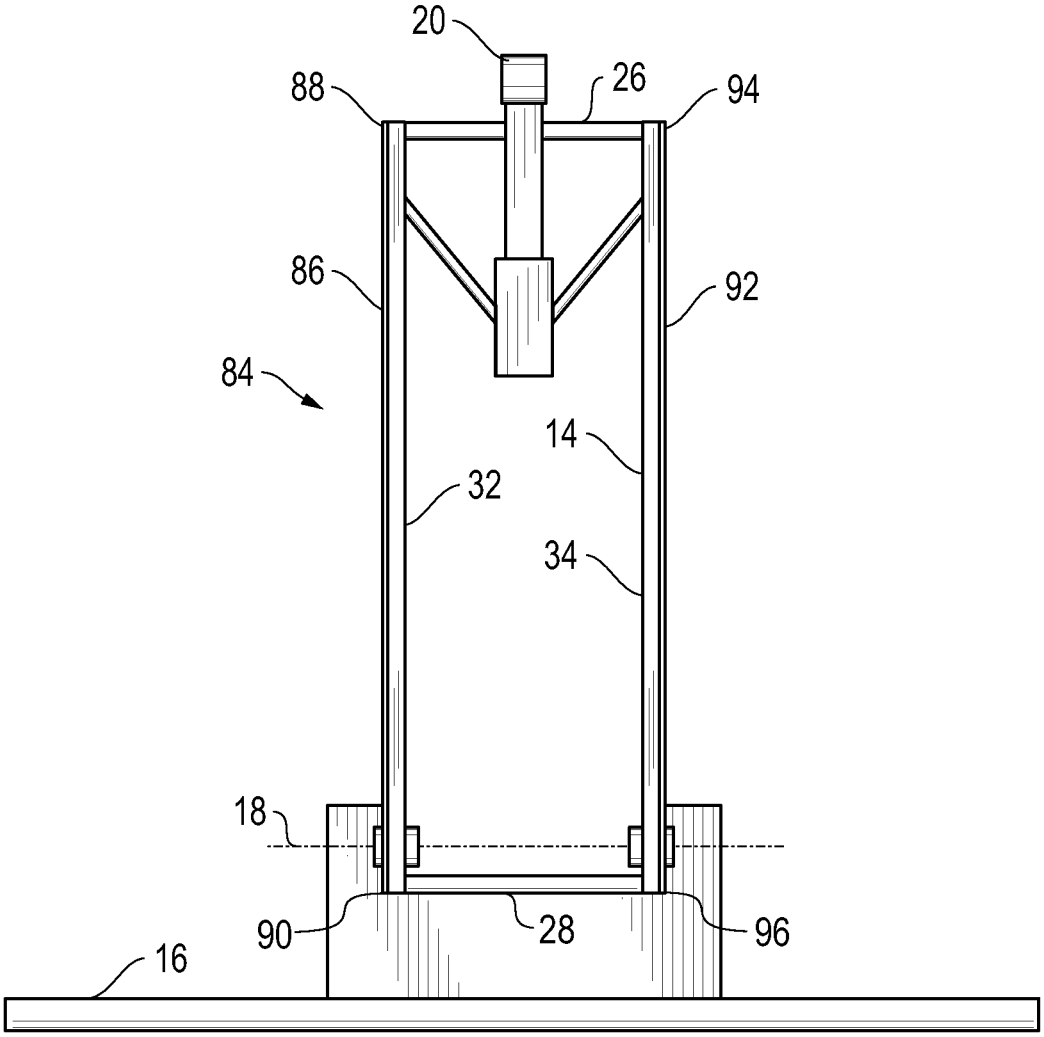
FIG. 12 shows a front elevational view of the third alternative embodiment of the present invention.

Referring to FIG. 12, there is shown a front elevational view of the third alternative embodiment of the tensioning apparatus 84 of the present invention, taken along line 12-12 of FIG. 11. The first cable 86 of the apparatus 84 has an end 88 attached to a top 26 of the main rotating structural member 14 and an opposite end 90 attached to the bottom 28 of the main rotating structural member 14. The second cable 92 has an end 94 attached to the top 26 of the main rotating structural member 14 and an opposite end 96 attached to the bottom 28 of the main rotating structural member 14. The cables 86 and 92 continuously tension the main rotating structural member 14 as the main rotating structural member moves between the first position and the second position. Cable 86 is parallel to the side 32 of the main rotating structural member 14. The cable 92 is parallel to the opposite side 34 of the main rotating structural member 14. The tension of the cables 86 and 92 provides rigidity to the main rotating structural member 14 so as to help prevent sideways motions of the main rotating structural member 14 due to various forces imparted on the main rotating structural member when delivering tubulars to a well head.

The various embodiments discussed above all add structural rigidity to the main rotating structural member 14 of the pipe handling apparatus 12. The preferred embodiments shown in FIGS. 1-3 add the most rigidity to the main rotating structural member 14 because the cables 38 and 44 extend angularly outwardly from the front 30 of the main rotating structural member 14 and from the sides 32 and 34 of the main rotating structural member 14. The cables 52 and 58 of the first alternative embodiment 50 are aligned with the pivot axis 18 of the main rotating structural member 14. The cables 52 and 58 do extend angularly outwardly from the sides 32 and 34 of the main rotating structural member 14. Therefore, the cables 52 and 58 of the first alternative embodiment prevent sideways motions to a greater extent than they prevent forward and backward motions of the main rotating structural member 14. The cables 52 and 58 add structural rigidity to the main rotating structural member 14 and are a viable alternative to the preferred embodiment in the event that the cables 52 and 58 cannot be extended in front of the main rotating structural member 14. The cables 66 and 72 of the second alternative embodiment 64 extend angularly outwardly from the front 30 of the main rotating structural member 14. The cables 66 and 72 are parallel to the sides 32 and 34 of the main rotating structural member 14, respectively. Thus, the cables 66 and 72 of the second alternative embodiment prevent forward and backward movement of the main rotating structural member 14 to a greater extent than they prevent sideways movement of the main rotating structural member 14. The orientation of the cables 66 and 72 in the second alternative embodiment 64 is an alternative to the preferred embodiment in the case that it is not practical to angle the cables 66 and 72 outwardly from the sides 32 and 34 of the main rotating structural member 14. The cables 86 and 92 of the third alternative embodiment 84 are attached to the main rotating structural member 14, but are not attached to a fixed surface. The cables 86 and 92 add rigidity to the main rotating structural member 14 so as to help prevent forward and backward and sideways movement of the main rotating structural member 14. The third alternative embodiment 84 of cables 86 and 92 are a viable alternative to the preferred embodiment in the case that the cables 86 and 92 cannot be attached to a fixed surface.

The main rotating structural member 14 may be a boom. The main rotating structural member 14 rotates through delivery of the pipe 82 and achieves between 45°-90° of rotation.

The foregoing disclosure and description of the invention is illustrative and explanatory thereof. Various changes in the details of the illustrated construction and method can be made within the scope of the claims without departing from the true spirit of the invention. The present invention should only be limited by the following claims and their legal equivalents.

I claim:

1. A pipe handling apparatus comprising:

a skid;

a main rotating structural member pivoting about a pivot point relative to the skid, the main rotating structural member pivoting between a first position and a second position;

a lever pivotally connected to the main rotating structural member, the lever having a first end extending outwardly from a well side of the main rotating structural member, the lever having a second end extending outwardly from an opposite side of the main rotating structural member;

an arm pivotally connected to the first end of the lever;

a gripper assembly connected to an end of the arm opposite the lever for gripping a tubular therein; and, a first tensioning member affixed adjacent to an upper end of the main rotating structural member and extending outward away from the main rotating structural member, the first tensioning member applying no tension to the main rotating structural member when the main rotating structural member is in the first position, and the first tensioning member applying a tension to the main rotating structural member when the main rotating structural member is in the second position.

2. The apparatus of claim 1, further comprising:

the first tensioning member having an opposite end attached to a location near a bottom of the main rotating structural member; and a second tensioning member having an end attached adjacent to the top of the main rotating structural member, the second tensioning member having an opposite end attached to a location near the bottom of the main rotating structural member.

3. The apparatus of claim 2, wherein the second tensioning member is attached to a side of the main rotating structural member opposite the first tensioning member.

4. The apparatus of claim 3, wherein the first and second tensioning members tension the main rotating structural member in the second position, the first and second tensioning members applying no tension when the main rotating structural member is in the first position.

5. The apparatus of claim 4, wherein the first and second tensioning members are attached in a location in front of the main rotating structural member.

6. The apparatus of claim 2, wherein the first and second tensioning members are cables.

7. The apparatus of claim 1, further comprising:

wherein the first tensioning member has an opposite end attached to a fixed surface a from the main rotating structural member; and a second tensioning member has an end attached adjacent the top of the main rotating structural member, the second tensioning member having an opposite end attached to the fixed surface.

8. The apparatus of claim 7, wherein the first and second tensioning members are attached to the fixed surface along the pivot axis of the main rotating structural member.

9. The apparatus of claim 8, wherein the first tensioning member extends angularly outwardly from a side of the main rotating structural member, and the second tensioning member extends angularly outwardly from an opposite side of the main rotating structural member.

10. The apparatus of claim 9, wherein the first and second tensioning members tension the main rotating structural member in the second position, the first and second tensioning members applying no tension when the main rotating structural member is in the first position.

11. The apparatus of claim 7, wherein the first and second tensioning members extend angularly outwardly from a front of the main rotating structural member.

12. The apparatus of claim 11, wherein the first tensioning member extends angularly outwardly from a side of the main rotating structural member, and the second tensioning member extends angularly outwardly from an opposite side of the main rotating structural member.

13. The apparatus of claim 12, wherein the first and second tensioning members tension the main rotating structural member in the second position, the first and second tensioning members applying no tension when the main rotating structural member is in the first position.

14. The apparatus of claim 11, wherein the first and second tensioning members are attached to the fixed surface in alignment with the main rotating structural member, the first tensioning member being generally parallel to the side of the main rotating structural member, the second tensioning member being generally parallel to the opposite side of the main rotating structural member.

15. The apparatus of claim 1 further comprising a link having a first end pivotally connected to the second end of the lever, the link having a second end pivotally connected to the skid.

16. A method of tensioning a main rotating structural member of a pipe handling apparatus, the main rotating structural member rotating about a pivot axis from a first position to a second position, the method comprising:

attaching a first tensioning member adjacent a top of the main rotating structural member;

attaching an opposite end of the first tensioning member to a fixed location near a bottom of the main rotating structural member;

attaching a second tensioning member adjacent the top of the main rotating structural member;

attaching an opposite end of the second tensioning member to a fixed location near the bottom of the main rotating structural member;

applying no tension to the first and second tensioning members while in the first position;

pivoting the rotating main structural member from the first position, by lifting the top of the main rotating structural member, to a second position and tensioning the main rotating structural member in the second position with the first and second tensioning members;

pivoting a lever outwardly from the main rotating structural member when the main rotating structural member is in the second position, the lever having a first end extending outwardly from a well side of the main rotating structural member, the lever having a second end extending outwardly from an opposite side of the main rotating structural member;

pivoting an arm outwardly from the first end of the lever when the main rotating structural member is in the second position; and gripping a tubular with one or more grippers at an end of the arm when the main rotating structural member is in the first position.

17. The method of claim 16, further comprising:

extending the first tensioning member angularly outwardly from a side of the main rotating structural member; and extending the second tensioning member angularly outwardly from an opposite side of the main rotating structural member.

18. The method of claim 16, further comprising:

extending the first and second tensioning members angularly outwardly from a front of the main rotating structural member.

19. The method of claim 16, the fixed location being aligned with the pivot axis of the main rotating structural member.

20. The method of claim 16, the fixed location being a surface of the main rotating structural member.

21. The method of claim 16, wherein the first and second tensioning members are cables.

22. The method of claim 16 further comprising the step of pivoting a link in response to the rotation of the main rotating structural member, a first end of the link pivoting from the second end of the lever, a second end of the link pivoting near the bottom of the main rotating structural member.

* * * * *

UNITED STATES PATENT AND TRADEMARK OFFICE

CERTIFICATE OF CORRECTION

PATENT NO. : 8,469,648 B2
APPLICATION NO. : 12/259252
DATED : June 25, 2013
INVENTOR(S) : Keith J. Orgeron It is certified that error appears in the above-identified patent and that said Letters Patent is hereby corrected as shown below:

In the Claims

Column 16
Line 49, delete 2nd occurrence of "a" and insert --away--

Signed and Sealed this
Twenty-ninth Day of April, 2014

Michelle K. Lee

Michelle K. Lee
*Deputy Director of the United States Patent and Trademark Office*